US009579900B2

(12) United States Patent
Oya et al.

(10) Patent No.: US 9,579,900 B2
(45) Date of Patent: Feb. 28, 2017

(54) LIQUID SUPPLY UNIT

(71) Applicant: SEIKO EPSON CORPORATION, Tokyo (JP)

(72) Inventors: Shun Oya, Matsumoto (JP); Atsushi Kobayashi, Matsumoto (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/134,230

(22) Filed: Apr. 20, 2016

(65) Prior Publication Data

US 2016/0229193 A1 Aug. 11, 2016

Related U.S. Application Data

(63) Continuation of application No. 14/878,529, filed on Oct. 8, 2015, now Pat. No. 9,346,277, which is a (Continued)

(30) Foreign Application Priority Data

Dec. 18, 2013 (JP) ..... 2013-260964
Dec. 26, 2013 (JP) ..... 2013-270007

(Continued)

(51) Int. Cl.
*B41J 2/175* (2006.01)
*B41J 2/17* (2006.01)

(52) U.S. Cl.
CPC ..... *B41J 2/17526* (2013.01); *B41J 2/175* (2013.01); *B41J 2/1714* (2013.01); *B41J 2/1752* (2013.01);

(Continued)

(58) Field of Classification Search
CPC .. B41J 2/17513; B41J 2/1752; B41J 2/17526; B41J 2/17503; B41J 2/17509; B41J 2/17553; B41J 2/21
See application file for complete search history.

(56) References Cited

U.S. PATENT DOCUMENTS 4,556,012 A 12/1985 Scrudato
5,182,581 A 1/1993 Kashimura et al.

(Continued)

FOREIGN PATENT DOCUMENTS

CN 1572511 A 2/2005
EP 0993954 A2 4/2000

(Continued)

*Primary Examiner* — Juanita D Jackson
(74) *Attorney, Agent, or Firm* — Stroock & Stroock & Lavan LLP

(57) ABSTRACT

A cartridge 5 is mounted on a carriage 8. The carriage 8 includes liquid introducing parts 710*m*, 710*c* and 710*y* and a guide projection 723. The guide projection 723 is extended from between the liquid introducing parts 710*m* and 710*c* toward the liquid introducing part 710*y*. The cartridge 5 includes an ink supply port 507*m* connectable with the liquid introducing part 710*m* to supply magenta ink to the liquid introducing part 710*m*, an ink supply port 507*c* connectable with the liquid introducing part 710*c* to supply cyan ink to the liquid introducing part 710*c*, an ink supply port 507*y* connectable with the liquid introducing part 710*y* to supply yellow ink to the liquid introducing part 710*y*, and a first groove 580. The first groove 580 is extended from between the ink supply port 507*m* and the ink supply port 507*c* toward the ink supply port 507*y* to allow for insertion of the guide projection 723. This configuration suppresses diffusion of ink leaked from any of the liquid supply ports of the cartridge.

3 Claims, 25 Drawing Sheets

Related U.S. Application Data continuation of application No. 14/573,053, filed on Dec. 17, 2014, now Pat. No. 9,266,340.

(30) Foreign Application Priority Data

| | | |
|---|---|---|
| Dec. 27, 2013 | (JP) | 2013-272477 |
| Jan. 30, 2014 | (JP) | 2014-015767 |
| Feb. 3, 2014 | (JP) | 2014-018365 |
| Feb. 19, 2014 | (JP) | 2014-029769 |
| Feb. 21, 2014 | (JP) | 2014-031192 |
| Feb. 26, 2014 | (JP) | 2014-034847 |
| Feb. 28, 2014 | (JP) | 2014-037928 |
| Feb. 28, 2014 | (JP) | 2014-037929 |
| Mar. 7, 2014 | (JP) | 2014-045198 |
| Mar. 20, 2014 | (JP) | 2014-057360 |
| Mar. 25, 2014 | (JP) | 2014-061295 |
| Mar. 25, 2014 | (JP) | 2014-061296 |
| Mar. 25, 2014 | (JP) | 2014-061297 |
| Jun. 9, 2014 | (JP) | 2014-118344 |

(52) U.S. Cl.
CPC ..... *B41J 2/1753* (2013.01); *B41J 2/17523* (2013.01); *B41J 2/17553* (2013.01)

(56) References Cited

U.S. PATENT DOCUMENTS

| | | | |
|---|---|---|---|
| 5,488,401 | A | 1/1996 | Mochizuki et al. |
| 5,552,861 | A | 9/1996 | Mizude et al. |
| 5,619,239 | A | 4/1997 | Kotaki et al. |
| 6,000,789 | A | 12/1999 | Takagi et al. |
| 6,102,533 | A | 8/2000 | Nozawa et al. |
| 6,152,555 | A | 11/2000 | Nozawa et al. |
| 6,170,941 | B1 | 1/2001 | Hara et al. |
| 6,250,750 | B1 | 6/2001 | Miyazawa et al. |
| 6,276,780 | B1 | 8/2001 | Carrese et al. |
| 6,302,530 | B1 | 10/2001 | Shimada et al. |
| 6,375,315 | B1 | 4/2002 | Steinmetz et al. |
| 6,439,491 | B1 | 8/2002 | Liao |
| 6,739,708 | B2 | 5/2004 | Studer et al. |
| 6,776,479 | B2 | 8/2004 | Ardito et al. |
| 6,899,417 | B1 | 5/2005 | Shinada et al. |
| 7,178,909 | B2 | 2/2007 | Yoshiyama et al. |
| 7,258,431 | B2 | 8/2007 | Shinada et al. |
| 7,300,142 | B1 | 11/2007 | Usui et al. |
| 8,297,738 | B1 | 10/2012 | Kodama et al. |
| 2002/0118262 | A1 | 8/2002 | Seino et al. |
| 2002/0158948 | A1 | 10/2002 | Miyazawa et al. |
| 2004/0246304 | A1 | 12/2004 | Takahashi et al. |
| 2004/0246317 | A1 | 12/2004 | Hayashi et al. |
| 2005/0168549 | A1 | 8/2005 | Shinada et al. |
| 2006/0066696 | A1 | 3/2006 | Matsumoto et al. |
| 2006/0290757 | A1 | 12/2006 | Shinada et al. |
| 2008/0049080 | A1 | 2/2008 | Hayashi et al. |
| 2008/0049081 | A1* | 2/2008 | Hayashi ..... B41J 2/17513 347/86 |

FOREIGN PATENT DOCUMENTS

| | | | |
|---|---|---|---|
| JP | 07-148936 | A | 6/1995 |
| JP | 09-011500 | A | 1/1997 |
| JP | 10-016249 | A | 1/1998 |
| JP | 10-235890 | A | 9/1998 |
| JP | 10-278290 | A | 10/1998 |
| JP | 10-286972 | A | 10/1998 |
| JP | 2000-033707 | A | 2/2000 |
| JP | 2000-190522 | A | 7/2000 |
| JP | 2001-121715 | A | 5/2001 |
| JP | 2001-253087 | A | 9/2001 |
| JP | 3248831 | B | 11/2001 |
| JP | 2002-292905 | A | 10/2002 |
| JP | 2003-072099 | A | 3/2003 |
| JP | 2004-230704 | A | 8/2004 |
| JP | 2004-358914 | A | 12/2004 |
| JP | 2005-028883 | A | 2/2005 |
| JP | 2005-125559 | A | 5/2005 |
| JP | 2006-088650 | A | 4/2006 |
| JP | 2006-175885 | A | 7/2006 |
| JP | 2006-247932 | A | 9/2006 |
| JP | 2006-289770 | A | 10/2006 |
| JP | 2008-074090 | A | 4/2008 |
| JP | 2008-074100 | A | 4/2008 |
| JP | 2013-141804 | A | 7/2013 |
| JP | 2013-158980 | A | 8/2013 |

* cited by examiner

LIQUID SUPPLY UNIT

CROSS-REFERENCE TO RELATED APPLICATIONS

This application is a continuation application of U.S. patent application Ser. No. 14/878,529, filed on Oct. 8, 2015, now U.S. Pat. No. 9,346,277, which is a continuation application of U.S. patent application Ser. No. 14/573,053, filed on Dec. 17, 2014, now U.S. Pat. No. 9,266,340, which claims priorities to Japanese Patent Applications No. (JP) 2013-260964 filed on Dec. 18, 2013, JP 2013-270007 filed on Dec. 26, 2013, JP 2013-272477 filed on Dec. 27, 2013, JP 2014-015767 filed on Jan. 30, 2014, JP 2014-18365 filed on Feb. 3, 2014, JP 2014-29769 filed on Feb. 19, 2014, JP 2014-31192 filed on Feb. 21, 2014, JP 2014-34847 filed on Feb. 26, 2014, JP 2014-37928 filed on Feb. 28, 2014, JP 2014-37929 filed on Feb. 28, 2014, JP 2014-45198 filed on Mar. 7, 2014, JP 2014-57360 filed on Mar. 20, 2014, JP 2014-61295 filed on Mar. 25, 2014, JP 2014-61296 filed on Mar. 25, 2014, JP 2014-61297 filed on Mar. 25, 2014, and JP 2014-118344 filed on Jun. 9, 2014, entire disclosures of which are incorporated herein by reference for all purposes.

BACKGROUND

The present invention relates to a liquid supply unit.

An ink cartridge (also simply called "cartridge") configured to supply ink to a printer as an example of a liquid ejection device has been known conventionally as a liquid supply unit configured to supply a liquid to the liquid ejection device. A cartridge containing a plurality of different color inks has been proposed to supply the respective color inks through respective ink supply ports to the printer as disclosed in Japanese Patent Publication (JP 2008-74090A).

SUMMARY

The technique proposed in JP 2008-74090A has the supply ports for the respective color inks sealed by a seal member to prevent leakage of ink in the cartridge attachment state. In the course of attachment or detachment of the cartridge, however, the ink supply port is exposed, so that there is a possibility that ink is leaked from the cartridge. In the cartridge attachment state, degradation of the seal member may cause leakage of ink. In the event of leakage of one color ink from its ink supply port, the leaked ink may be diffused along the bottom wall surface of the cartridge and reach the periphery of the ink supply port for another color ink. In the course of attachment or detachment of the cartridge, the another color ink may be contaminated with the leaked ink reaching the periphery of the ink supply port for the another color ink. This may lead to color mixing of the supplied ink. The cartridge has contacts or terminals for receiving and sending electric signals. There is also a need to prevent the contacts or the terminals from being exposed to the leaked ink. There is accordingly a need to more effectively suppress diffusion of the leaked ink. In a liquid supply unit configured to contain and supply a liquid, a liquid ejection device configured to receive supply of a liquid from the liquid supply unit and a system including the liquid supply unit and the liquid ejection device, there are other needs including downsizing, cost reduction, resource saving, easy manufacture and improvement of usability.

In order to solve at least part of the problems described above, the invention may be implemented by an aspect described below.

(1) According to one aspect of the invention, there is provided a liquid supply unit configured to supply a liquid. The liquid supply unit is mountable on a liquid supply unit mounting structure having a first liquid introducing part, a second liquid introducing part, a third liquid introducing part and a projection which is located between the first liquid introducing part and the second liquid introducing part and is located from between the first liquid introducing part and the second liquid introducing part to the third liquid introducing part. The liquid supply unit comprises: a first liquid supply port configured to be connectable with the first liquid introducing part such as to supply a first liquid to the first liquid introducing part; a second liquid supply port configured to be connectable with the second liquid introducing part such as to supply a second liquid to the second liquid introducing part; a third liquid supply port configured to be connectable with the third liquid introducing part such as to supply a third liquid to the third liquid introducing part; and a groove formed between the first liquid supply port and the second liquid supply port and extended from between the first liquid supply port and the second liquid supply port toward the third liquid supply port, such as to allow the projection to be inserted therein. In the liquid supply unit of this aspect, in the event of leakage of the third liquid from the third liquid supply port, this configuration enables the leaked third liquid to be guided to the groove which is extended toward the third liquid supply port and to be kept in the groove. The liquid supply unit of this aspect accordingly suppresses diffusion of the leaked third liquid and prevents contamination of the leaked liquids. The liquid supply unit of this aspect suppresses diffusion of the leaked third liquid by the simple structure of the groove extended from between the first liquid supply port and the second liquid supply port toward the third liquid supply port.

(2) The liquid supply unit of the above aspect may further comprise: a first wall configured to have the first liquid supply port, the second liquid supply port, the third liquid supply port and the groove; a second wall opposed to the first wall; a third wall arranged to intersect with the first wall and the second wall; a fourth wall arranged to intersect with the first wall and the second wall and opposed to the third wall; a fifth wall arranged to intersect with the first wall and the second wall; and a sixth wall arranged to intersect with the first wall and the second wall and opposed to the fifth wall. In a plan view of the liquid supply unit in a direction from the first wall toward the second wall, the first liquid supply port may be located between the fifth wall and the sixth wall, the second liquid supply port may be located between the first liquid supply port and the sixth wall, the groove may be extended from the fourth wall toward the third wall, and the third liquid supply port may be located between the groove and the third wall. This configuration enables the leaked third liquid to be guided to the groove which is formed in the first wall and is extended toward the third liquid supply port and to be kept in the groove. The liquid supply unit of this aspect suppresses diffusion of the leaked third liquid along the wall surface of the first wall and prevents contamination of the leaked liquids. In the liquid supply unit of this aspect, the groove is formed between the first liquid supply port located between the fifth wall and the sixth wall and the second liquid supply port located between the first liquid supply port and the sixth wall and is extended from the fourth wall toward the third wall. This configuration also enables the first liquid leaked from the first liquid supply port or the second liquid leaked from the second liquid supply port to be kept in the groove, thus suppressing diffusion of the leaked first liquid or the leaked second liquid and preventing contamination by the leaked first liquid or the leaked second liquid. The liquid supply unit of this aspect suppresses diffusion of any of the leaked liquids by the simple structure of the groove formed between the first liquid supply port which is located between the fifth wall and the sixth wall and the second liquid supply port which is located between the first liquid supply port and the sixth wall and extended from the fourth wall toward the third wall.

(3) The liquid supply unit of the above aspect may further comprise: a contact located on an outer wall surface of the third wall and arranged to be electrically connectable with an electrode on the liquid supply unit mounting structure. In the plan view of the liquid supply unit in the direction from the first wall toward the second wall, the third liquid supply port may be located between the groove and the contact. This configuration keeps the leaked third liquid in the groove and suppresses diffusion of the leaked third liquid along the wall surface of the first wall toward the contact, thus reducing the likelihood that the contact is exposed to the leaked third liquid.

(4) The liquid supply unit of the above aspect may further comprise: a first partition wall arranged to intersect with the first wall and the second wall and located between the fifth wall and the sixth wall; a second partition wall arranged to intersect with the first wall, the second wall and the first partition wall and located between the fourth wall and the third wall; a first liquid chamber defined by at least the first wall, the second wall, the fourth wall, the fifth wall, the first partition wall and the second partition wall and arranged to communicate with the first liquid supply port; a second liquid chamber defined by at least the first wall, the second wall, the fourth wall, the sixth wall, the first partition wall and the second partition wall and arranged to communicate with the second liquid supply port; and a third liquid chamber defined by at least the first wall, the second wall, the third wall, the sixth wall and the first partition wall and arranged to communicate with the third liquid supply port. In the plan view of the liquid supply unit in the direction from the first wall toward the second wall, the groove may be located between the fourth wall and the third liquid chamber. This configuration keeps the leaked third liquid in the groove so as to suppress diffusion of the leaked third liquid along the wall surface of the first wall and prevent contamination of the leaked liquids, and additionally causes the liquids contained in the first to the third liquid chambers to be introduced to the first to the third liquid introducing parts of the liquid supply unit mounting structure.

(5) In the liquid supply unit of the above aspect, the groove may be formed as a concave in the first partition wall. This configuration enables the groove to be readily formed without reducing the capacities of the first liquid chamber and the second liquid chamber for containing the respective liquids.

(6) In the liquid supply unit of the above aspect, in the plan view of the liquid supply nit in the direction from the first wall toward the second wall, the groove may be located between the fourth wall and a specific area where the first wall is in contact with a third seal element formed around a periphery of the third liquid introducing part of the liquid supply unit mounting structure. This simple configuration enhances the effectiveness of keeping the leaked third liquid in the groove and thereby suppressing diffusion of the leaked third liquid along the wall surface of the first wall and the effectiveness of preventing contamination by the leaked third liquid.

(7) In the liquid supply unit of the above aspect, the fourth wall may have a concave arranged to be continuous with the groove. This configuration has the following advantageous effects. The liquid supply unit is generally inclined and approaches downward the liquid supply unit mounting structure in the course of attachment of the liquid supply unit to the liquid supply unit mounting structure. A fourth wall-side portion of the groove approaches a projection of the liquid supply unit mounting structure earlier than a third wall-side portion of the groove. In the course of attachment of the liquid supply unit, the projection accordingly enters the concave continuous with the groove. Insertion of the projection into the concave defines the insertion attitude of the liquid supply unit and guides the insertion direction of the liquid supply unit. The liquid supply unit of this aspect accordingly facilitates attachment of the liquid supply unit and enhances the fit of the liquid supply unit.

(8) In the liquid supply unit of the above aspect, the concave of the fourth wall may have a shallower depth in the direction from the first wall toward the second wall than depth of the groove in the direction from the first wall toward the second wall. This configuration has the following advantageous effects. In the course of attachment of the liquid supply unit, the projection of the liquid supply unit mounting structure first enters the concave of the liquid supply unit as described above. Setting the depth of the concave shallower than the depth of the groove prevents the fourth wall from excessively coming close to the first liquid introducing part or the second liquid introducing part of the liquid supply unit mounting structure. The liquid supply unit of this aspect accordingly prevents the fourth wall from carelessly coming into contact with the first liquid introducing part or the second liquid introducing part of the liquid supply unit mounting structure or its periphery in the course of attachment of the liquid supply unit.

(9) The liquid supply unit of the above aspect may have a first outer shape including the first liquid supply port, the second liquid supply port, the third liquid supply port, the groove and a contact which is configured to be electrically connectable with an electrode of the liquid supply unit mounting structure, in a plan view of the liquid supply unit in a first direction, a second outer shape in a plan view of the liquid supply unit in a second direction opposite to the first direction, a third outer shape including the contact in a plan view of the liquid supply unit in a third direction orthogonal to the first direction, a fourth outer shape in a plan view of the liquid supply unit in a fourth direction opposite to the third direction, a fifth outer shape in a plan view of the liquid supply unit in a fifth direction orthogonal to the first direction and the third direction, and a sixth outer shape in a plan view of the liquid supply unit in a sixth direction opposite to the fifth direction. The liquid supply unit of any of various shapes keeps the leaked third liquid in the groove, so as to suppress diffusion of the leaked third liquid along the wall surface of the first wall and prevent contamination of the leaked liquids.

(10) In the liquid supply unit of the above aspect, the third liquid supply port may be located between the groove and the contact in the plan view of the liquid supply unit in the first direction. This configuration keeps the leaked third liquid in the groove and suppresses diffusion of the leaked third liquid along the wall surface of the first wall toward the contact, thus reducing the likelihood that the contact is exposed to the leaked liquids.

(11) The liquid supply unit of the above aspect may further comprise: a liquid chamber configured to separately contain the first liquid, the second liquid and the third liquid; a first member configured to have the first liquid supply port, the second liquid supply port, the third liquid supply port and the groove; and a second member placed on the first member and configured to have a terminal including a contact that is electrically connectable with an electrode of the liquid supply unit mounting structure. The liquid supply unit having the multi-part structure including the first member and the second member keeps the leaked third liquid in the groove and suppresses diffusion of the leaked third liquid as described above.

(12) The liquid supply unit of the above aspect may further comprise: a first member configured to have the first liquid supply port, the second liquid supply port, the third liquid supply port and the groove; and a second member configured to be attachable to and detachable from the first member and to have a terminal including a contact that is electrically connectable with an electrode of the liquid supply unit mounting structure. The liquid supply unit having the multi-part structure including the first member and the second member keeps the leaked third liquid in the groove and suppresses diffusion of the leaked third liquid as described above.

(13) The liquid supply unit of the above aspect may further comprise: a first member configured to have the first liquid supply port, the second liquid supply port, the third liquid supply port, a terminal including a contact that is electrically connectable with an electrode of the liquid supply unit mounting structure, and the groove; and a second member configured to be attachable to the first liquid supply port, the second liquid supply port and the third liquid supply port, such as to supply the first liquid through the first liquid supply port to the first liquid introducing part, supply the second liquid through the second liquid supply port to the second liquid introducing part and supply the third liquid through the third liquid supply port to the third liquid introducing part. The liquid supply unit having the multi-part structure including the first member and the second member keeps the leaked third liquid in the groove and suppresses diffusion of the leaked third liquid as described above.

(14) According to another aspect, there is provided a liquid supply unit configured to be attachable to and detachable from a liquid ejection device. The liquid supply unit comprises: a groove; a liquid supply port through which a liquid is supplied to the liquid ejection device; and a terminal assembly configured to be electrically connectable with the liquid ejection device. The liquid supply port is located between the groove and the terminal assembly. The liquid supply unit of this aspect keeps the liquid leaked from the liquid supply port in the groove and suppresses diffusion of the leaked liquid, thus reducing the likelihood that the terminal assembly is exposed to the leaked liquid.

(15) According to another aspect, there is provided a liquid supply unit configured to be attachable to and detachable from a liquid ejection device. The liquid supply unit comprises: a first wall configured to have a groove and a liquid supply port through which a liquid is supplied to the liquid ejection device; a second wall opposed to the first wall; a fourth wall arranged to intersect with the first wall and the second wall; and a third wall arranged to intersect with the first wall and the second wall, opposed to the fourth wall and configured to have a terminal assembly which is electrically connectable with the liquid ejection device. In a plan view of the liquid supply unit in a direction from the first wall toward the second wall, the liquid supply port is located between the groove and the terminal assembly. The liquid supply unit of this aspect keeps the liquid leaked from the liquid supply port in the groove and suppresses diffusion of the leaked liquid, thus reducing the likelihood that the terminal assembly is exposed to the leaked liquid.

All the plurality of components included in the aspect of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention may be implemented by any of various other aspects: for example, a liquid ejection device configured to receive supply of a liquid from the liquid supply unit and a system including the liquid supply unit and the liquid ejection device.

DESCRIPTION OF EMBODIMENTS

Some aspects of the invention will be described below.

A. Embodiment

A-1. Configuration of Liquid Ejection System 1

Figure 1:
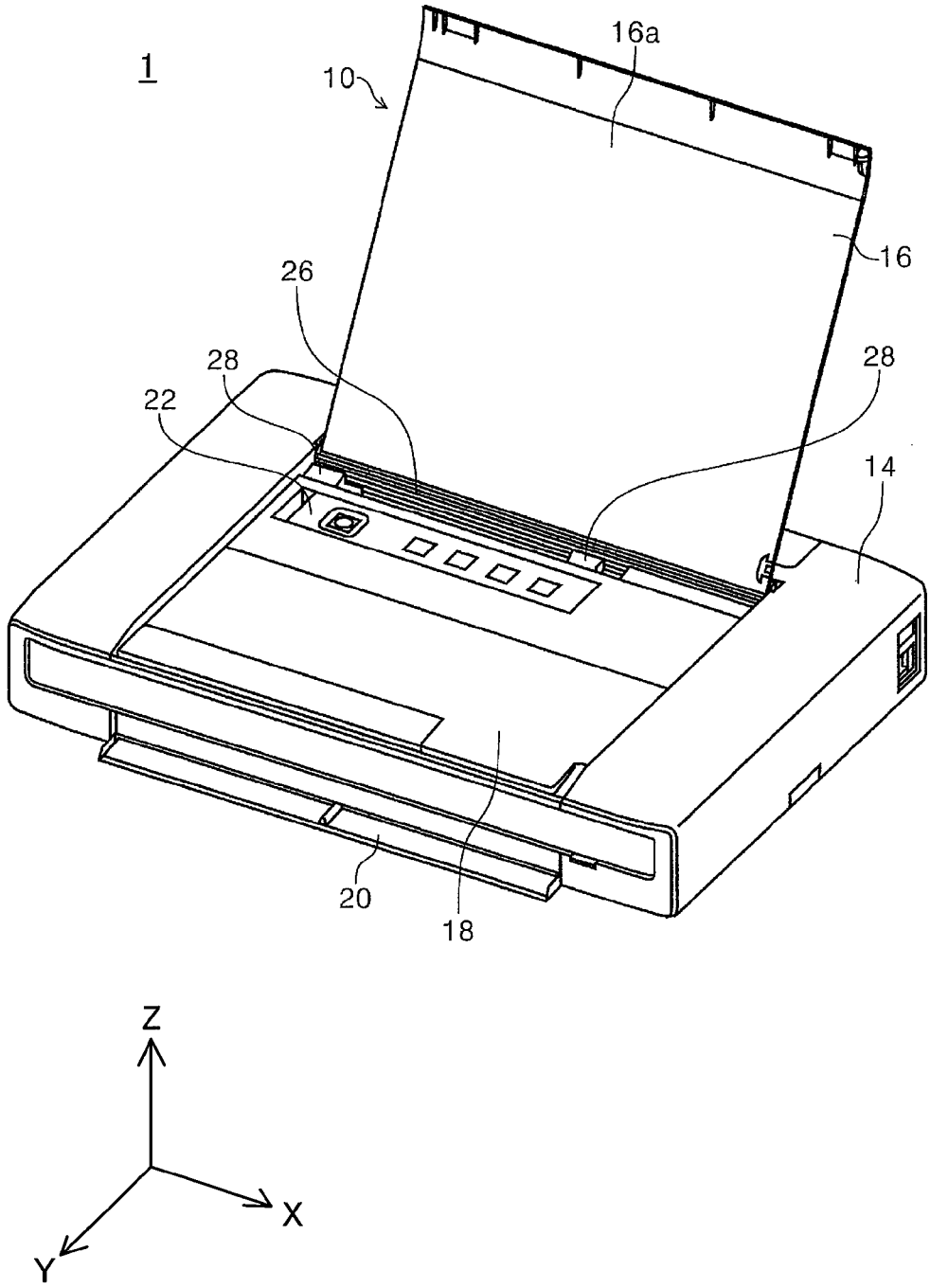
FIG. 1 is a perspective view illustrating the general configuration of a liquid ejection system.
Figure 2:
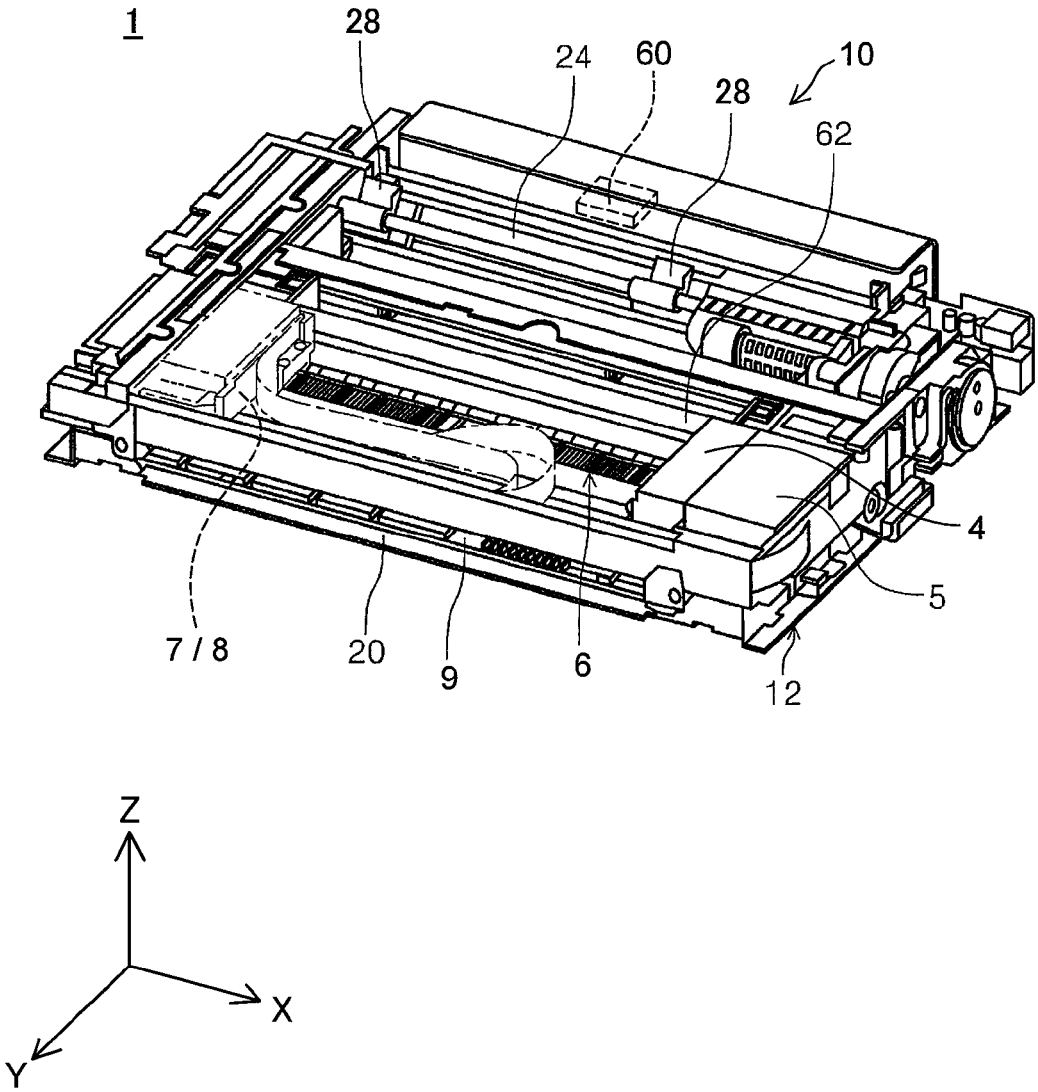
FIG. 2 is a perspective view schematically illustrating the internal configuration of the liquid ejection system.

FIG. 1 is a perspective view illustrating the general configuration of a liquid ejection system 1, and FIG. 2 is a perspective view schematically illustrating the internal configuration of the liquid ejection system 1. XYZ axes orthogonal to one another are shown in FIGS. 1 and 2. The X axis denotes an axis along a direction in which a carriage 8 described later moves back and force and is more specifically an axis along a main scan direction of printing accompanied with the back and forth motion of the carriage 8. The Y axis denotes an axis along a feed path direction of paper sheets in the liquid ejection system 1 placed on a horizontal plane such as desk and is more specifically an axis along a sub scan direction of printing accompanied with the back and forth motion of the carriage 8. The Z axis denotes an axis along the top-bottom direction of the liquid ejection system 1 placed on the horizontal plane such as desk. In other illustrations subsequent to FIG. 2, the XYZ axes are shown as needed. The XYZ axes in FIGS. 1 and 2 correspond to the XYZ axes in the other illustrations. The liquid ejection system 1 includes a printer 10 as a liquid ejection device and two different types of cartridges 4 and 5. As shown in FIG. 2, in the liquid ejection system 1 of this embodiment, the cartridges 4 and 5 are attachable to and detachable from a cartridge attachment structure 7 of the printer 10. The cartridge attachment structure 7 is mounted on a carriage 8 equipped with an ejection head 8*s* for ink ejection (FIG. 5) and is generally integrated with the carriage 8. In the description below, the cartridge 4 is called "first cartridge 4" and the cartridge 5 is called "second cartridge 5".

The first cartridge 4 contains a single color ink, for example, black ink. The second cartridge 5 contains a plurality of different color inks and includes three liquid containing parts according to this embodiment. The second cartridge 5 of this embodiment contains three different color inks, yellow, magenta and cyan.

The number of cartridges and the types of cartridges attached to the cartridge attachment structure 7 are, however, not limited to the configuration of this embodiment. For example, four first cartridges 4 may be provided corresponding to four different color inks, black, cyan, magenta and yellow and may be attached to the cartridge attachment structure 7. In another example, a cartridge containing another or other color inks (for example, light magenta and light cyan) may be attached to the cartridge attachment structure 7. In the application that the multiple first cartridges 4 are attached corresponding to the respective color inks, attachment of the second cartridge 5 may be omitted.

The printer 10 is an inkjet printer. As shown in FIG. 1, the printer 10 includes a housing 14, a paper feeding unit cover 16, a recording unit protective cover 18, a paper output unit cover 20 and an operation unit 22. As shown in FIG. 2, the printer 10 has a device body 12.

As shown in FIG. 1, the housing 14 is arranged to surround the periphery of the device body 12 and forms the appearance of the printer 10. The paper feeding unit cover 16 is provided on an upper surface of the printer 10. The paper feeding unit cover 16 is placed on an upper surface of the housing 14 to be rotatable. The paper feeding unit cover 16 is movable between an open position relative to the housing 14 (FIG. 19 and a closed position (not shown). When the paper feeding unit cover 16 is at the closed position relative to the housing 14, the paper feeding unit cover 16, in combination with the upper surface of the housing 14, forms the upper surface of the printer 10.

When the paper feeding unit cover 16 is at the open position relative to the housing 14, the paper feeding unit cover 16 is inclined relative to a rear surface side (−Y-direction side) of the printer 10. In this state, a rear surface of the paper feeding unit cover 16 serves as a mounting surface 16*a* on which paper sheets are placed. When the paper feeding unit cover 16 is at the open position relative to the housing 14, a paper slot 26 of a paper feeding unit 24 included in the device body 12 as described later is open up in the printer 10. This accordingly enables the paper feeding unit 24 to feed the paper sheets placed on the mounting surface 16*a* to a paper feed path. The paper feed path denotes a paper moving path in the course of printing. The paper slot 26 has a pair of paper guides 28. The pair of paper guides 28 are arranged to adjust the interval in the width direction (X-axis direction) of the printer 10. The pair of paper guides 28 serve to fasten both ends of a paper sheet in the width direction and specify the position of the paper sheet in the width direction.

When the paper feeding unit cover 16 is at the open position relative to the housing 14, the recording unit protective cover 18 and the operation unit 22 are exposed to be accessible on the upper surface of the printer 10. The recording unit protective cover 18 is movable between an open position relative to the housing 14 (not shown) and a closed position (FIG. 1). When the recording unit protective cover 18 is at the open position relative to the housing 14, a recording unit 6 provided in the device body 12 is made accessible for the user.

The operation unit 22 is provided with a power button and print settings buttons for operating the printer 10. When the paper feeding unit cover 16 is at the open position relative to the housing 14, the operation unit 22 is made accessible for the user and allows the user to operate the printer 10.

Additionally, the paper output unit cover 20 is provided on a front surface of the housing 14. The paper output unit cover 20 is placed on the front surface of the housing 14 to be rotatable. The paper output unit cover 20 is movable between an open position relative to the housing 14 (FIG. 1) and a closed position (not shown). When the paper output unit cover 20 is at the open position relative to the housing 14, a paper sheet after recording can be discharged from a paper output unit 9 of the device body 12 toward the front side of the printer 10.

As illustrated in FIG. 2, the device body 12 includes the paper feeding unit 24, the recording unit 6, the paper output unit 9 and a controller 60.

The controller 60 is electrically connected with the paper feeding unit 24, the recording unit 6 and the paper output unit 9 and controls the operations of the respective units in response to instructions input from the operation unit 22. The controller 60 also controls the motion of the carriage 8 (motion in the X-axis direction: main scan drive) and the rotation of a feed roller shaft (sub-scan drive) via drive motors (not shown). The carriage 8 has the cartridge attachment structure 7 incorporated in its bottom. The controller 60 also transmits signals to and from circuit substrates included in the cartridges 4 and 5.

The device body 12 also includes a carriage guide rail 62 and a carriage driving unit (not shown) to make the carriage 8 movable along the carriage guide rail 62. The carriage guide rail 62 is extended in the X-axis direction, i.e., the width direction of the device body 12 and is placed in a bearing element 409 (FIG. 3) provided on the bottom side of the carriage 8 to support the carriage 8.

The carriage 8 having the cartridge attachment structure 7 mounted thereon is arranged to move back and forth in the width direction of the device body 12 (X-axis direction, main scan direction) by the carriage driving unit (not shown). The back and forth motion of the carriage 8 in the width direction of the device body 12 causes the cartridge attachment structure 7 to move back and forth in the width direction of the device body 12. The cartridges 4 and 5 are accordingly moved in a moving direction (X-axis direction) by the printer 10. The type of the printer 10 having the cartridges 4 and 5 attached to the cartridge attachment structure 7 provided on the carriage 8 for moving the ejection head like this embodiment is called "on-carriage type". In another application, a stationary cartridge attachment structure 7 may be provided at a different position from the carriage 8 to supply inks from the cartridges 4 and 5 attached to the cartridge attachment structure 7 to the ejection head of the carriage 8 via flexible tubes. This type of printer is called "off-carriage type". In this application, the cartridges 4 and 5 are not limited to detachable cartridges but may be stationary ink tanks. The ink tank may be provided with an ink filler port through which ink is injectable from outside.

In the use state of the liquid ejection system 1, the X axis denotes an axis along the main scan direction (left-right direction) in which the carriage 8 moves back and forth; the Y axis denotes an axis along the sub-scan direction (top-bottom direction) in which paper sheets are fed; and the Z axis denotes an axis along the vertical direction (top-bottom direction). Upward in the vertical direction is +Z direction, and downward in the vertical direction is −Z direction. The use state of the liquid ejection system 1 denotes the state of the liquid ejection system 1 placed on a horizontal plane. According to this embodiment, the horizontal plane is a plane parallel to the X axis and the Y axis (XY plane).

A-2. Cartridge Attachment State and Carriage Structure

Figure 3:
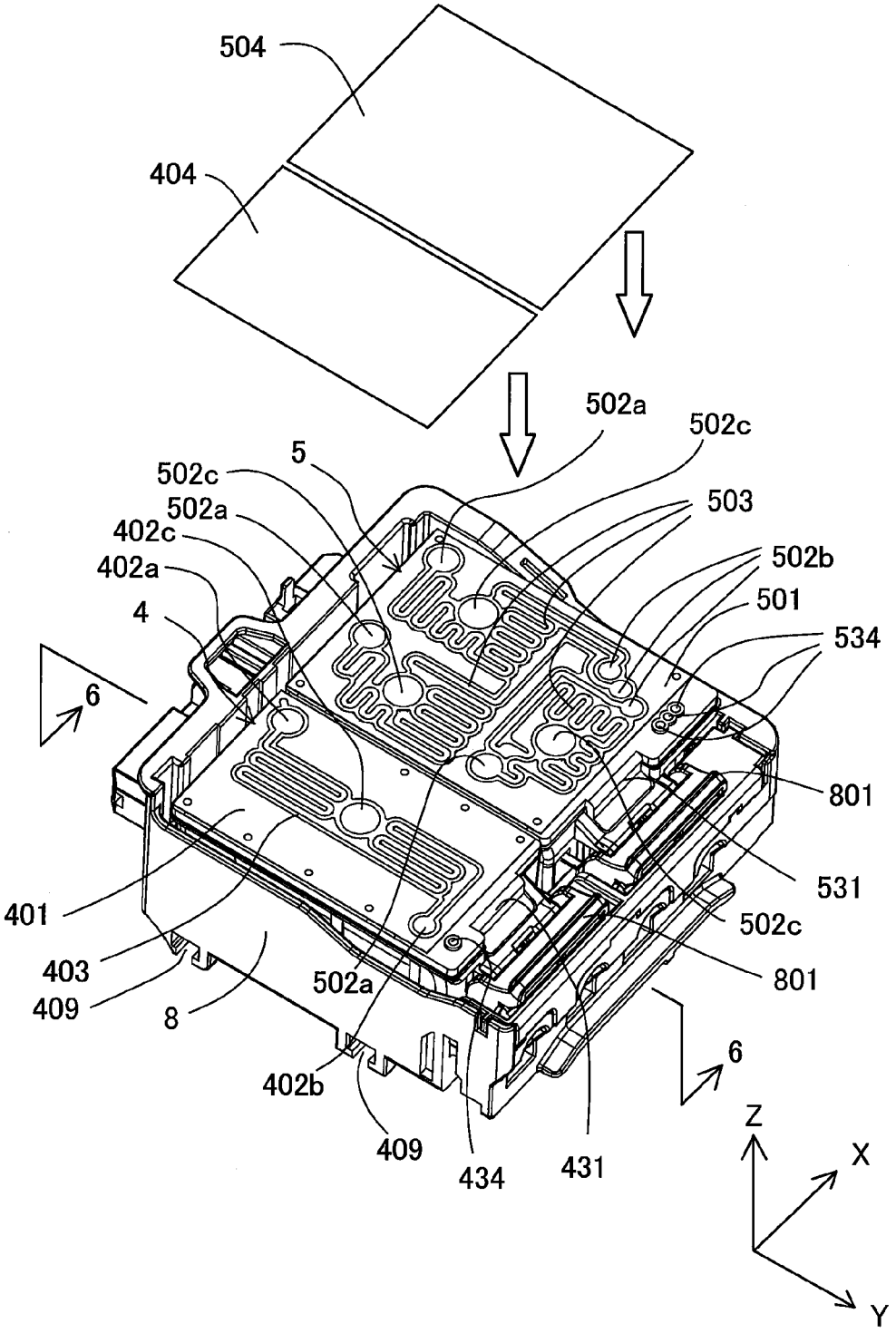
FIG. 3 is a perspective view schematically illustrating the appearance of a carriage in the cartridge attachment state.
Figure 4:
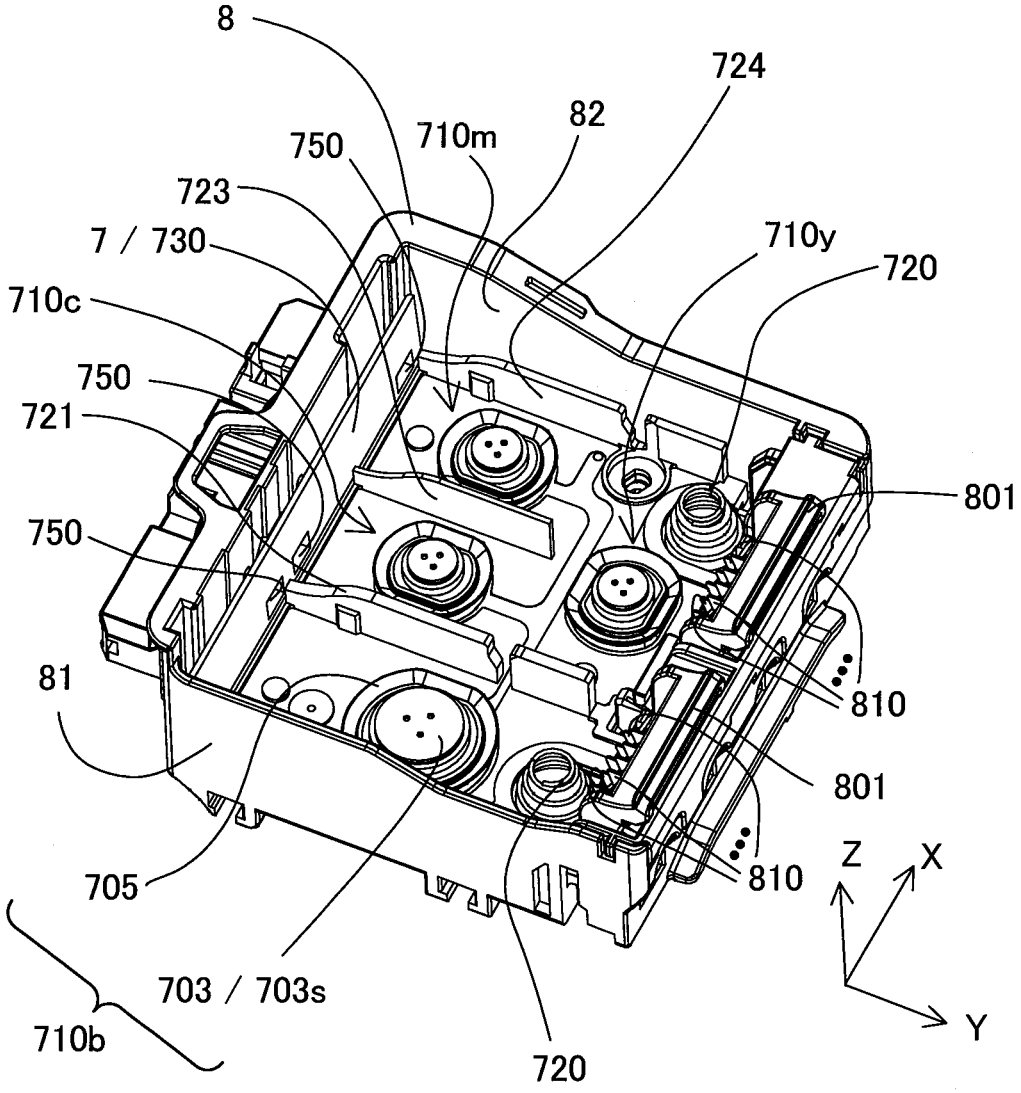
FIG. 4 is a schematic perspective view illustrating the carriage in the non-cartridge attachment state.
Figure 5:
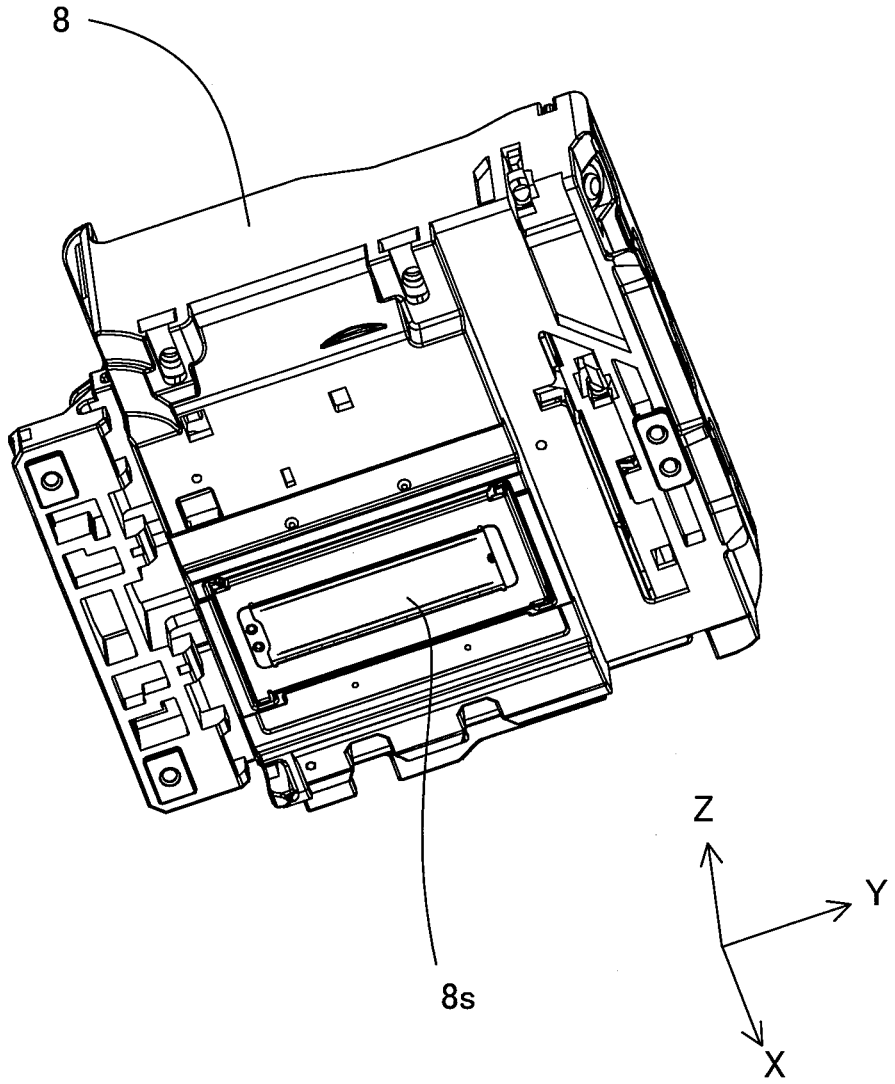
FIG. 5 is a schematic perspective view illustrating the carriage in the non-cartridge attachment state, viewed from the bottom side.
Figure 6:
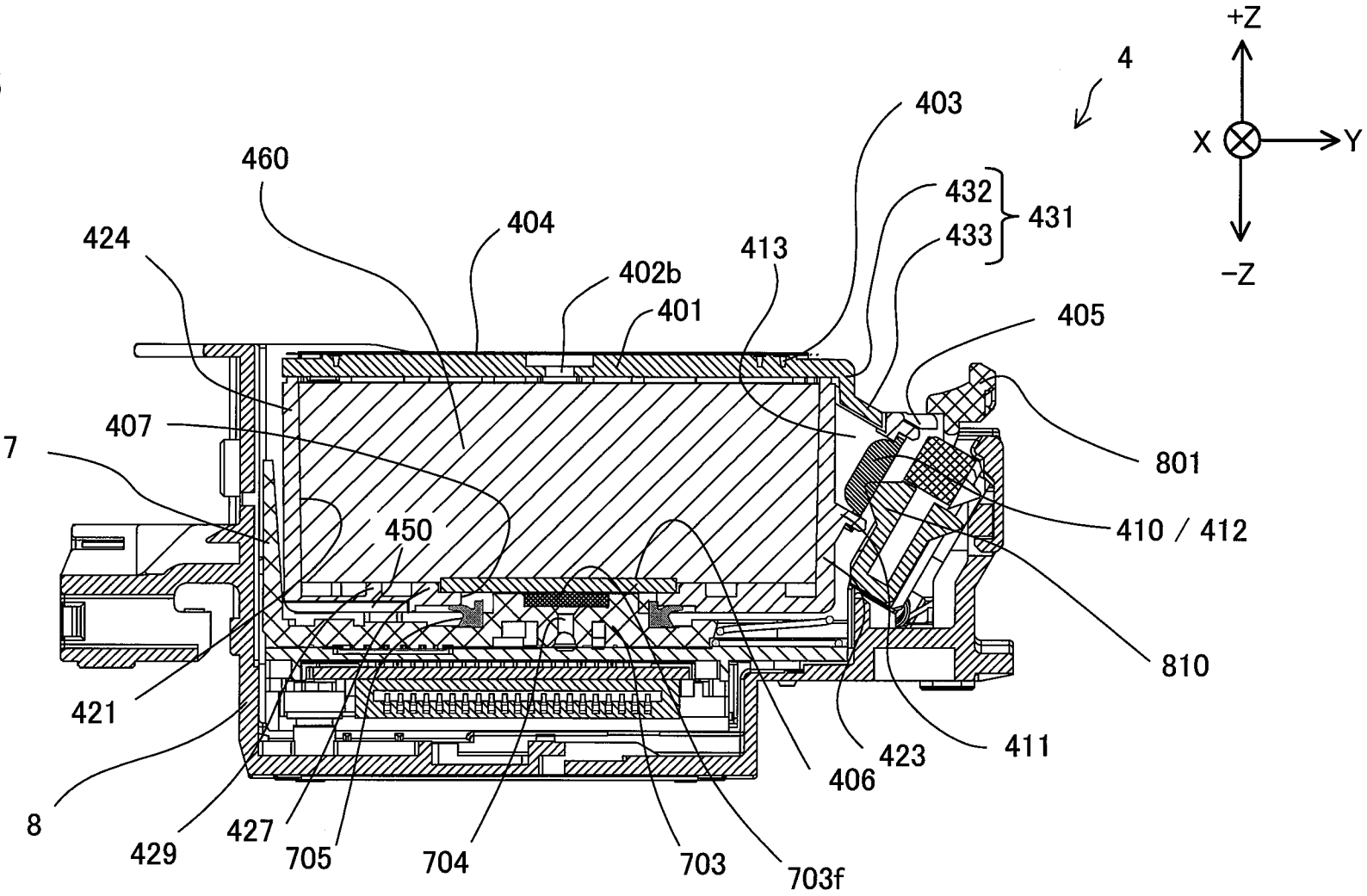
FIG. 6 is a schematic cross sectional view, taken on a line 6-6 in FIG. 3.

FIG. 3 is a perspective view schematically illustrating the appearance of the carriage 8 in the cartridge attachment state. FIG. 4 is a schematic perspective view illustrating the carriage 8 in the non-cartridge attachment state. FIG. 5 is a schematic perspective view illustrating the carriage 8 in the non-cartridge attachment state, viewed from the bottom side. FIG. 6 is a schematic cross sectional view, taken on a line 6-6 in FIG. 3. The cartridge attachment structure 7 is mounted on the bottom of the carriage 8 and is omitted from the illustration of FIG. 3.

As shown in FIG. 3, the cartridges 4 and 5 respectively have covers 401 and 501. The cover 401 has through holes 402*a*, 402*b* and 402*c* formed to pass through the cover 401, an air groove 403 arranged in a serpentine shape from the through hole 402*a* to the through hole 402*c* and an air communication hole 434. The cover 501 has through holes 502*a*, 502*b* and 502*c* formed to pass through the cover 502, air grooves 503 arranged in a serpentine shape from the through hole 502*a* to the through hole 502*c* and air communication holes 534. In the manufacturing process of the cartridge 4, the through hole 402*a* is used as an evacuation hole to suck the air from inside of the cartridge 4 and keep the inside of the cartridge 4 in the reduced pressure. After manufacture of the cartridge 4, the through hole 402*a* is used to supply the air to a liquid retaining member 460 described later through the air groove 403, the through hole 402*c* and the air communication hole 434. In the manufacturing process of the cartridge 4, the through hole 402*b* is used as an ink ejection hole through which ink is injected into inside of the cartridge 4. After manufacture of the cartridge 4, the through hole 402*b* is sealed and closed by a seal member 404. The cartridge 5 is configured to contain the three different color inks, yellow, magenta and cyan as described above and accordingly have the through holes 502*a*, 502*b* and 502*c*, the air grooves 503 and the air communication holes 534 at positions corresponding to respective color ink containing parts described later. The cartridges 4 and 5 respectively have seal members 404 and 504 to be joined with the upper surfaces of the covers 401 and 501 and cover the openings of the above through holes and air grooves.

The cartridge 4 and 5 joined with the seal members 404 and 504 are attached to the carriage 8 via the cartridge attachment structure 7 incorporated in the bottom of the carriage 8, as shown in FIG. 4. In this attachment state, the cartridges 4 and 5 are aligned in the moving direction of the carriage 8 (X-axis direction). In the attachment state, an engagement element 405 described later as an attachment/detaching mechanism included in the cartridge 4 is engaged with a cartridge engagement arm 801 of the carriage 8. The user may apply an external force to the cartridge engagement arm 801 to rotate and displace the cartridge engagement arm 801 and release engagement of the cartridge 4 with the carriage 8. The user can then detach the cartridge 4 from the carriage 8. The cartridge 5 can also be detached from the carriage 8 by the structure and method similar to those described above with respect to the cartridge 4.

As shown in FIG. 4, the carriage 8 has the cartridge attachment structure 7. The cartridge attachment structure 7 includes a liquid introducing part 710*b* for black ink, a liquid introducing part 710*y* for yellow ink, a liquid introducing part 710*m* for magenta ink, a liquid introducing part 710*c* for cyan ink, and cone-shaped coil springs 720. The coil springs 720 are placed corresponding to the cartridges 4 and 5. The coil spring 720 is compressed in the cartridge attachment state and is stretched to press up the cartridge 4 or 5 in the state of releasing the engagement of the cartridge engagement arm 801. An elastic member 705 is a member made of, for example, an elastomer and formed in a ring shape and is mounted on an outer wall section of a liquid introducing base 703.

The respective liquid introducing parts 710 for the respective color inks are provided corresponding to the liquid containing parts of the cartridges 4 and 5 attached to the cartridge attachment structure 7 and have similar structures with some difference in size. The structure of the liquid introducing part 710*b* is described as an example. The liquid introducing part 710*b* includes a liquid introducing base 703, a metal mesh 703*s* and an elastic member 705. The metal mesh 703*s* is provided as a filter made of a metal having corrosion resistance, such as stainless steel and is placed on an upper end of the liquid introducing base 703 to be in surface contact with a supply port-side liquid retaining member 406 of the cartridge 4 described below (FIG. 6). Ink retained in the supply port-side liquid retaining member 406 passes through the metal mesh 703*s* and is supplied to the ejection head 8*s* provided on the bottom surface of the carriage 8 as shown in FIG. 5. The relationship between the respective liquid introducing parts 710 and the cartridges will be described later.

The cartridge 4 has a circuit substrate 410 on a +Y-direction end, as shown in FIG. 6. This circuit substrate 410 is fixed to a substrate mounting structure 411 inclined relative to a first end wall 423. Fixation of the circuit substrate 410 to the substrate mounting structure 411 and the location of the circuit substrate 410 will be described later. The circuit substrate 410 provided on the cartridge 4 has terminals 412 described later. In the state of attachment of the cartridge 4 to the carriage 8, contacts of the terminals 412 are electrically in contact with electrodes of an electrode assembly 810 of the carriage 8. The cartridge 4 has the engagement element 405 provided on an end of the substrate mounting structure 411 in the Y-axis direction. The engagement element 405 is engaged with the cartridge engagement arm 801 of the carriage 8 in the state of attachment of the cartridge 4 to the carriage 8.

FIG. 6 illustrates the state of attachment of the cartridge 4 to the carriage 8. The cartridge 4 has a supply port-side liquid retaining member 406 and a liquid retaining member 460 serving to absorb and retain the liquid. The supply port-side liquid retaining member 406 and the liquid retaining member 460 are arranged to be in contact with each other. The metal mesh 703*s* attached to a ring-shaped end of the liquid introducing base 703 of the liquid introducing part 710*b* provided on the bottom surface of the cartridge attachment structure 7 is in surface contact with the supply port-side liquid retaining member 406. The supply port-side liquid retaining member 406 is lifted up in the +Z direction by the liquid introducing base 703 to press the liquid retaining member 460. This causes the liquid contained in the liquid retaining member 460, i.e., black ink, to be supplied to the ejection head 8*s* of the carriage 8 through the metal mesh 703*s* of the liquid introducing base 703 of the liquid introducing part 710*b* and a suction hole 704. Accordingly, the liquid introducing part 710*b* of the carriage 8 receives a liquid (black ink) introduced from the cartridge 4, and the carriage 8 causes the liquid (black ink) introduced to the liquid introducing part 710*b* to be ejected from the ejection head 8*s*. The cartridge 5 similarly has a circuit substrate 510 and the other relevant components like those of the cartridge 4 and is attached to the carriage 8 as described above.

The cartridge 4 has a liquid supply port 407 covered by the supply port-side liquid retaining member 406. The cartridge attachment structure 7 has the liquid-tight elastic member 705 at the foot of the liquid introducing base 703. This elastic member 705 is in contact with a peripheral concaved area 407*b* (FIG. 10) formed around the periphery of the liquid supply port 407 to seal the liquid supply port 407 and prevent leakage of ink from the liquid supply port 407 in the cartridge attachment state. The liquid supply port 407 is connected with the liquid introducing part 710*b* to supply black ink to the liquid introducing part 710*b* as described later. The structure of attaching the cartridge 4 to the cartridge attachment structure 7 of the carriage 8 will be described later.

The cartridge attachment structure 7 is mounted on the bottom of the carriage 8. As shown in FIG. 4, the cartridge attachment structure 7 has an inter-cartridge projection 721 a guide projection 723, and sidewall-side projections 724 extended in the Y-axis direction. In the illustration of FIG. 4, the sidewall-side projection 724 is illustrated inside of a carriage sidewall 82 on the back side of the sheet surface. The carriage 8 also has the sidewall-side projection 724 (not shown) inside of a carriage sidewall 81 on the front side of the sheet surface. Each of the inter-cartridge projection 721 and the sidewall-side projections 724 is extended from an end wall 730 of the cartridge attachment structure 7 toward the cartridge engagement arms 801 and is split in the middle.

The guide projection 723 is extended from the end wall 730 toward the liquid introducing part 710*y* to go between the liquid introducing part 710*m* and the liquid introducing part 710*c*. In other words, this guide projection 723 is formed between the liquid introducing part 710*m* and the liquid introducing part 710*c* adjacent to each other in the X-axis direction to be located between the liquid introducing part 710*c* and a part between the liquid introducing part 710*m* and the liquid introducing part 710*c*. The guide projection 723 has a lower projection height from the bottom surface of the cartridge attachment structure 7 in an area near to the end wall 730 than the projection height between the liquid introducing part 710*m* and the liquid introducing part 710*c*. The cartridge 4 is placed between the sidewall-side projection 724 (not shown) near to the carriage sidewall 81 and the inter-cartridge projection 721 and is attached to the cartridge attachment structure 7 of the carriage 8. The cartridge 5 is placed between the inter-cartridge projection 721 and the sidewall-side projection 724 near to the cartridge sidewall 82 and is attached to the cartridge attachment structure 7 of the carriage 8. The guide projection 723 is placed in a first groove 580 (FIG. 14) of the attached cartridge 5 described later. The cartridge attachment structure 7 also has engagement holes 750 formed in the end wall 730. The two engagement holes 750 are provided for each of the cartridge 4 and the cartridge 5. In the course of attachment of the cartridges 4 and 5, engagement projections 424*t* and 524*t* described later are fit in these engagement holes 750. Attachment of the cartridges 4 and 5 and the relationship between the guide projection 723 and the cartridge 5 will be described later.

A-3. Structure of Cartridge 4

Figure 7:
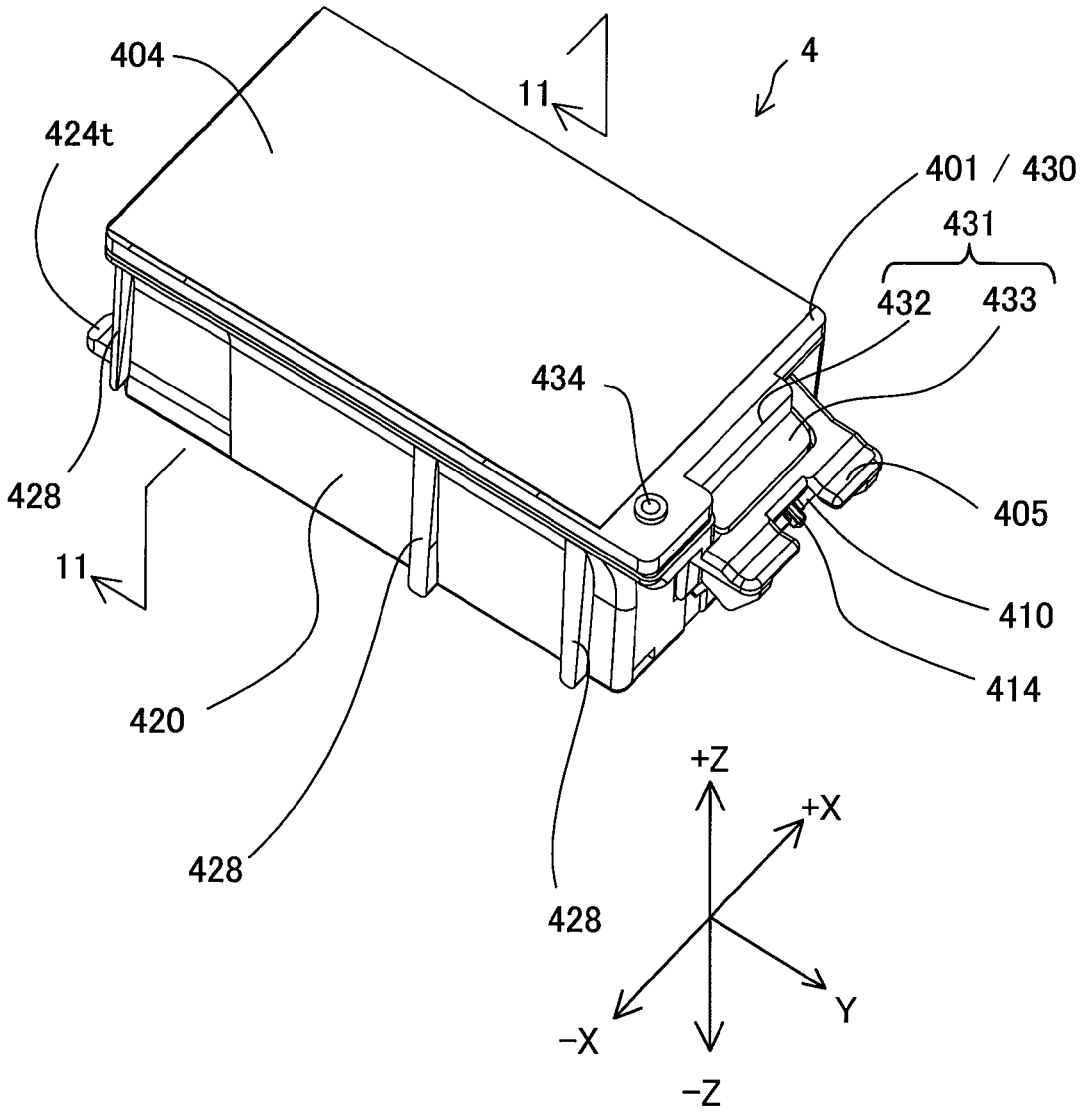
FIG. 7 is an appearance perspective view illustrating a cartridge.
Figure 8:
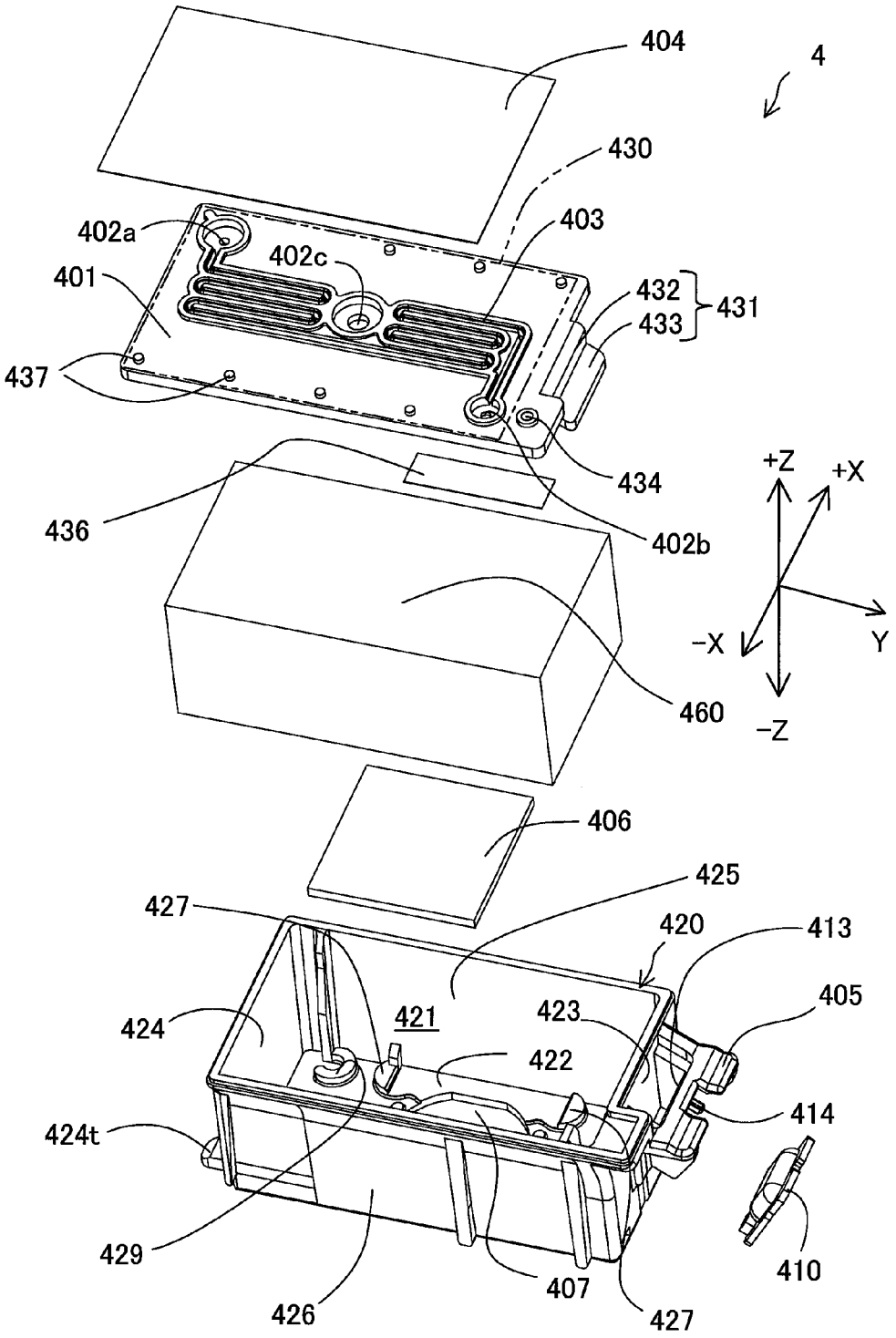
FIG. 8 is an exploded perspective view illustrating the cartridge of FIG. 7.
Figure 9:
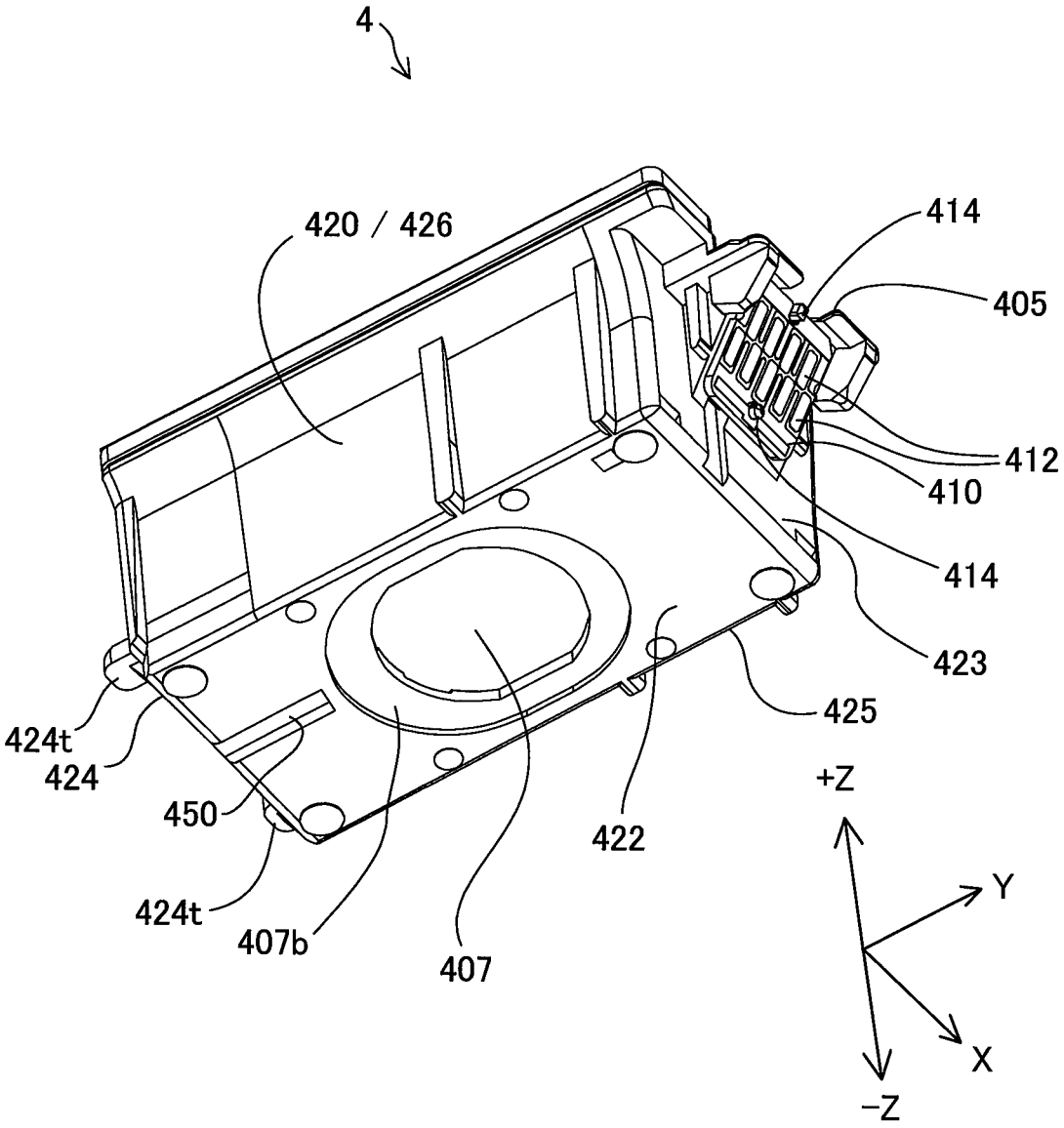
FIG. 9 is an appearance perspective view illustrating the cartridge of FIG. 7 viewed from the bottom side.
Figure 10:
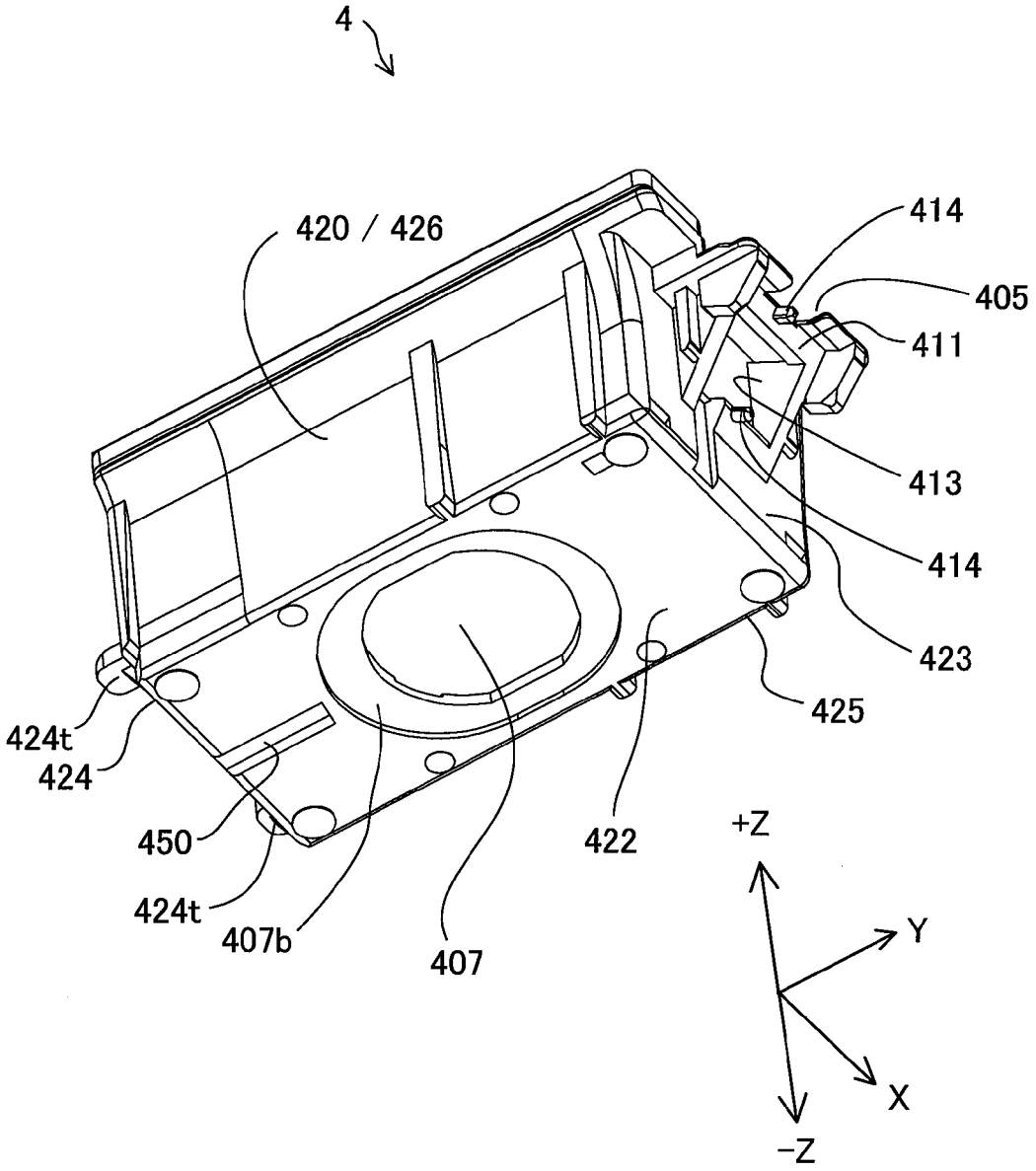
FIG. 10 is an appearance perspective view illustrating the cartridge of FIG. 7 without a circuit substrate viewed from the bottom side.
Figure 11:
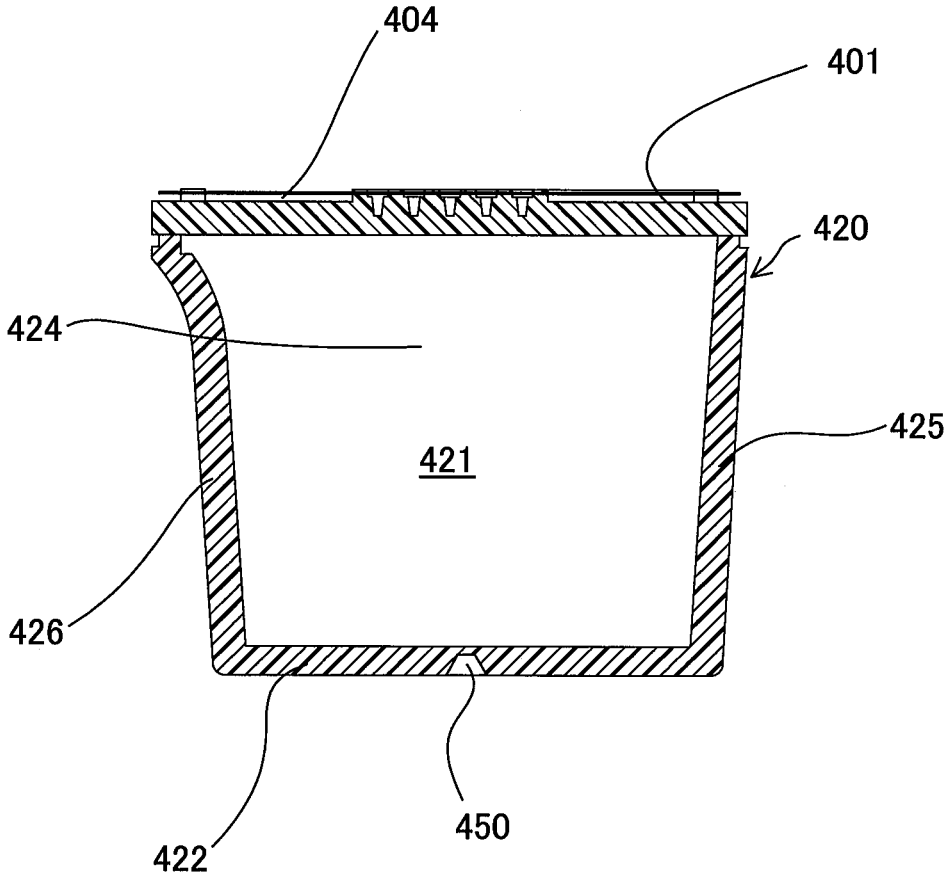
FIG. 11 is a schematic cross sectional end view illustrating a casing, taken on a line 11-11 in FIG. 7.

FIG. 7 is an appearance perspective view illustrating the cartridge 4. FIG. 8 is an exploded perspective view illustrating the cartridge 4. FIG. 9 is an appearance perspective view illustrating the cartridge 4 viewed from the bottom side. FIG. 10 is an appearance perspective view illustrating the cartridge 4 without the circuit substrate 410 viewed from the bottom side. FIG. 11 is a schematic cross sectional end view illustrating a casing 420, taken on a line 11-11 in FIG. 7. As illustrated, the cartridge 4 has the casing 420, the cover 401 and the circuit substrate 410. The cover 401 is fixed to the casing 420 to cover a recess 421 of the casing 420 (FIG. 8). The cartridge 4 also has the supply port-side liquid retaining member 406, the liquid retaining member 460, a cover backside seal member 436 and the seal member 404. The casing 420 and the cover 401 are molded products of a synthetic resin such as polyethylene or polypropylene and are formed by any adequate molding technique such as injection molding.

As shown in FIGS. 7 and 8, the casing 420 includes a bottom wall 422, a first end wall 423, a second end wall 424, a first side wall 425 and a second side wall 426. The outer wall surfaces of the first side wall 425 and the second side wall 426 are reinforced by ribs 428. The bottom wall 422 forms the bottom surface of the casing 420 and has the liquid supply port 407 formed at the center thereof. The bottom wall 422 is opposed to the cover 401 (more specifically a cover member 430 described below). The first end wall 423 rises from the bottom wall 422 to intersect with the cover member 430 of the cover 401. The second end wall 424 rises from the bottom wall 422 to intersect with the cover member 430 of the cover 401 and is opposed to the first end wall 423. The first side wall 425 rises from the bottom wall 422 between one edge (−X-direction edge in FIG. 8) of the first end wall 423 and one edge (−X-direction edge in FIG. 8) of the second end wall 424 to intersect with the cover member 430 of the cover 401. The second side wall 426 rises from the bottom wall 422 between the other edge (+X-direction edge in FIG. 8) of the first end wall 423 and the other edge (+X-direction edge in FIG. 8) of the second end wall 424 to intersect with the cover member 430 of the cover 401 and is opposed to the first side wall 425.

This wall configuration may also be expressed as follows. The casing 420 includes the bottom wall 422 with the liquid supply port 407 formed therein, the cover 401 opposed to the bottom wall 422, the first end wall 423 arranged to intersect with the bottom wall 422 and the cover 401, the second end wall 424 arranged to intersect with the bottom wall 422 and the cover 401 and opposed to the first end wall 423, the first side wall 425 arranged to intersect with the bottom wall 422 and the cover 401 and the second side wall 426 arranged to intersect with the bottom wall 422 and the cover 401 and opposed to the first side wall 425.

As shown in FIG. 9, the circuit substrate 410 has a plurality of terminals 412 on the substrate surface and is located on the first end wall 423 of the casing 420. The substrate mounting structure 411 is formed on the first end wall 423 as shown in FIG. 10. The substrate mounting structure 411 is arranged to be inclined relative to the first end wall 423. The circuit substrate 410 has the rear surface fixed to the substrate mounting structure 411 and is inclined relative to the first end wall 423. As shown in FIG. 9, the terminals 412 are arrayed zigzag in two lines on the circuit substrate 410. When the cartridge 4 is attached to the carriage 8 as described above, the contacts of the respective terminals 412 are electrically connected with electrodes of the electrode assembly 810 provided on the carriage 8 as shown in FIG. 6.

As shown in FIG. 10, the substrate mounting structure 411 has an opening 413 on the outer wall surface side of the first end wall 423. The opening 413 is extended in the Z-axis direction along the outer wall surface of the first end wall 423 from an upper edge side toward a lower edge side of the first end wall 423 (FIG. 8) and is open on the upper edge side and the lower edge side of the first end wall 423. In the state that the cover 401 is fixed to the casing 420, the opening 413 is closed on the upper edge side of the first end wall 423 by an outward extension member 431 of the cover 401 described later as shown in FIG. 7. Projections 414 protruded from the substrate mounting structure 411 are used for fixation of the circuit substrate 410 to the substrate mounting structure 411. The projections 414 are thermally caulked in the state that the projections 414 are extended from the circuit substrate 410 as shown in FIGS. 9 and 10. This fixes the circuit substrate 410 to the substrate mounting structure 411.

As shown in FIG. 8, the cover 401 has the cover member 430 and the outward extension member 431. The cover member 430 is in a flat plate-like shape and is arranged to cover the recess 421 of the casing 420. The outward extension member 431 is extended outward from the cover member 430 on the first end wall 423-side where the circuit substrate 410 with the terminals 412 is located, and includes a bent extension section 432 and an inclined extension section 433. The bent extension section 432 is bent at approximately 90 degrees to the cover member 430 and is extended to be protruded along a first direction from the cover 401 toward the casing 420 (−Z direction in FIG. 8). The inclined extension section 433 continuous with the bent extension section 432 is extended to a location to hang over the terminals 412 of the circuit substrate 410 in the plan view of the cover 401 in the first direction from the cover 401 toward the casing 420 (−Z direction in FIG. 8). In the state that the cover 401 is fixed to the casing 420, the outward extension member 431 is hung over the opening 413 to close the opening 413 on the upper edge side of the first end wall 423 as shown in FIGS. 6 and 10. In the state that the cover 401 is fixed to the casing 420, the inclined extension section 433 of the outward extension member 431 is engaged with the engagement element 405 as shown in FIG. 7. The outward extension member 431 is protruded to the outer side of at least the terminals 412 in the lower line of the circuit substrate 410 in a second direction from the second end wall 424 toward the first end wall 423 (+Y direction in FIGS. 6 and 8). In one modification, the inclined extension section 433 may be extended longer than the illustrated state to be protruded to the outer side of all the terminals 412 of the circuit substrate 410.

The cover 401 has the air communication hole 434 and a plurality of seal member receiving elements 437, in addition to the through holes 402*a*, 402*b* and 402*c* and the air groove 403 described above. The seal member receiving elements 437 are protruded from the upper surface of the cover 401 to substantially the same height as the height of the circumferential walls of the through holes 402*a*, 402*b* and 402*c* and the circumferential wall of the air groove 403 and serve as joint seat elements of the seal member 404.

The air communication hole 434 is provided in a cover member outer periphery formed by extending part of the cover member 430 in the Y-axis direction and is formed to pass through the cover 401 on its cover member outer periphery. The air communication hole 434 is connected with the through hole 402*b* by an air groove (not shown) on the rear surface of the cover 401. This air groove, the cover backside opening of the air communication hole 434 and the cover backside opening of the through hole 402*b* are sealed by the cover backside seal member 436. The recess 421 of the casing 420 closed by the cover 401 is accordingly open to the air through the air communication hole 434 via the through hole 402*a*, the air groove 403 and the through hole 402*b*. This arrangement of open to the air is described in relation to the liquid retaining member 460.

The liquid retaining member 460 is placed in the recess 421 of the casing 420. The bottom wall 422 of the casing 420 has step-like semicircular projections 427 formed on the periphery of the liquid supply port 407, and the supply port-side liquid retaining member 406 is placed on the steps of the semicircular projections 427 (FIG. 6). The liquid supply port 407 is accordingly covered by the supply port-side liquid retaining member 406. The bottom wall 422 also has arc-shaped projections 429 in an open arc shape in the plan view provided in the neighborhood of the respective corners. The liquid retaining member 460 is supported by the upper surfaces of the arc-shaped projections 429 at the respective corners and the semicircular projections 427 and is placed in the casing 420. In the state that the liquid retaining member 460 is placed in this manner, the cover 401 joined with the cover backside seal member 436 and the seal member 404 is welded and fixed to the casing 420 to complete the cartridge 4 shown in FIGS. 6 and 7.

Both the supply port-side liquid retaining member 406 and the liquid retaining member 460 may be made of a porous resin material. The porous resin material herein is not specifically limited but may be any porous resin material having the capacity of retaining the liquid, for example, a foamed material such as polyurethane foam or a fibrous material of bundled polypropylene fibers. The supply port-side liquid retaining member 406 and the liquid retaining member 460 have different characteristics of retaining the liquid. The supply port-side liquid retaining member 406 is made to have a higher pore density or density of pores than the liquid retaining member 460. According to the magnitude relationship of the pore density, the supply port-side liquid retaining member 406 has greater capillary force than the capillary force of the liquid retaining member 460.

This magnitude relationship of the capillarity force between the supply port-side liquid retaining member 406 and the liquid retaining member 460 causes ink contained in the liquid retaining member 460 to flow in the sequence described below. Ink flows from a member having smaller capillary force to a member having greater capillary force. As shown in FIG. 6, when ink contained in the supply port-side liquid retaining member 406 is sucked via the liquid introducing base 703 to be consumed, ink contained in the liquid retaining member 460 laid on the upper surface of the supply port-side liquid retaining member 406 moves to the supply port-side liquid retaining member 406. The driving force of such ink migration is mainly given by the capillary force of the supply port-side liquid retaining member 406. Such ink migration has no difficulty, due to the air communication through the air communication hole 434 via the through hole 402*a* and the air groove 403 continuous with the through hole 402*a* formed corresponding to the location where the liquid retaining member 460 is placed.

Placing the supply port-side liquid retaining member 406 and the liquid retaining member 460 having different characteristics in the recess 421 of the casing 420 as described above, in combination with using the metal mesh 703*s* having greater capillary force than the capillarity force of the supply port-side liquid retaining member 406 for the liquid introducing base 703, allows for efficient consumption of ink contained in the liquid retaining member 460. In other words, this reduces the remaining quantity of unused ink in the liquid retaining member 460.

As long as the capillary forces of the supply port-side liquid retaining member 406 and the liquid retaining member 460 are arranged to decrease with an increase in distance from the liquid introducing base 703, the magnitude relationship of the pore density between the respective liquid retaining members 406 and 460 is not limited to the configuration of this embodiment. For example, when the supply port-side liquid retaining member 406 and the liquid retaining member 460 have identical pore densities, the respective liquid retaining members 406 and 460 may be subjected to water repellent treatment or hydrophobic treatment to have the magnitude relationship of the capillary force described above.

The cartridge 4 also has a groove 450 formed on the bottom surface of the bottom wall 422 with the liquid supply port 407 (outer wall surface on the −Z direction side) as shown in FIGS. 9 and 10. This groove 450 is extended from the second end wall 424-side toward the liquid supply port 407 to reach the periphery of the peripheral concaved area 407*b* without interfering with the recess 421 as shown in FIG. 11. In the plan view of the cartridge 4 in a direction from the bottom wall toward the cover 401 (+Z direction), the liquid supply port 407 is located between the groove 450 and the circuit substrate 410 as shown in FIGS. 9 and 10. The width of the groove 450 in the X-axis direction on the bottom wall 422 is set to be narrower than the width of the peripheral concaved area 407*b* in the X-axis direction. Accumulation of ink in the groove 450 limits the ink diffusion area. The narrower width of the groove 450 effectively leads to the smaller diffusion area. The groove 450 may be formed to be continuous with the peripheral concaved area 407*b*. This configuration enables ink to be introduced into the groove 450 without leakage to outside of the peripheral concaved area 407*b*.

The cartridge 4 also has a pair of engagement projections 424*t* at a lower edge of the outer wall surface of the second end wall 424. In the course of attachment of the cartridge 4 to the cartridge attachment structure 7, the engagement projections 424*t* enter the end wall 730 of the cartridge attachment structure 7 (FIG. 4) and are involved in positioning of the cartridge 4.

A-4. Structure of Cartridge 5

Figure 12:
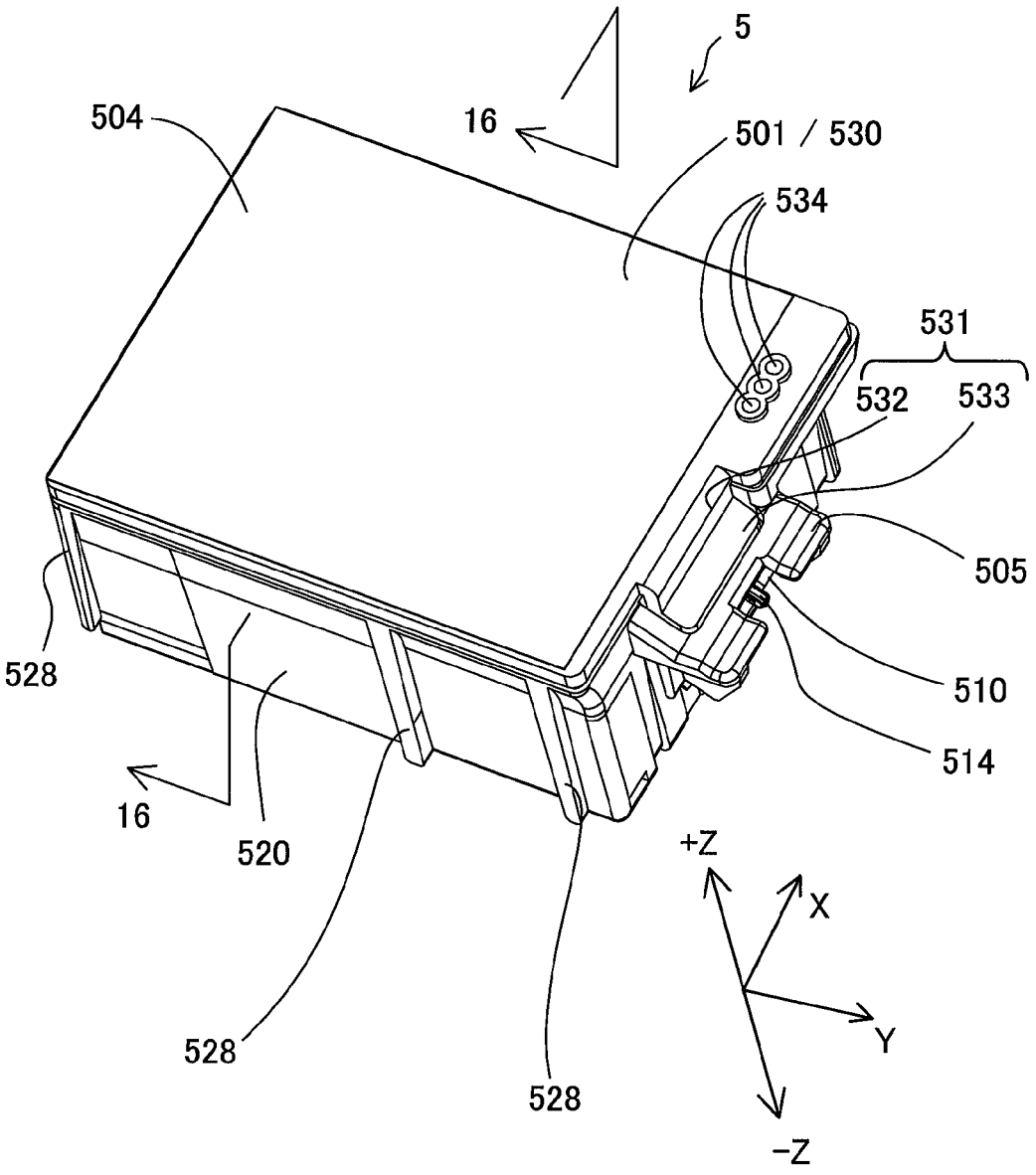
FIG. 12 is an appearance perspective view illustrating another cartridge.
Figure 13:
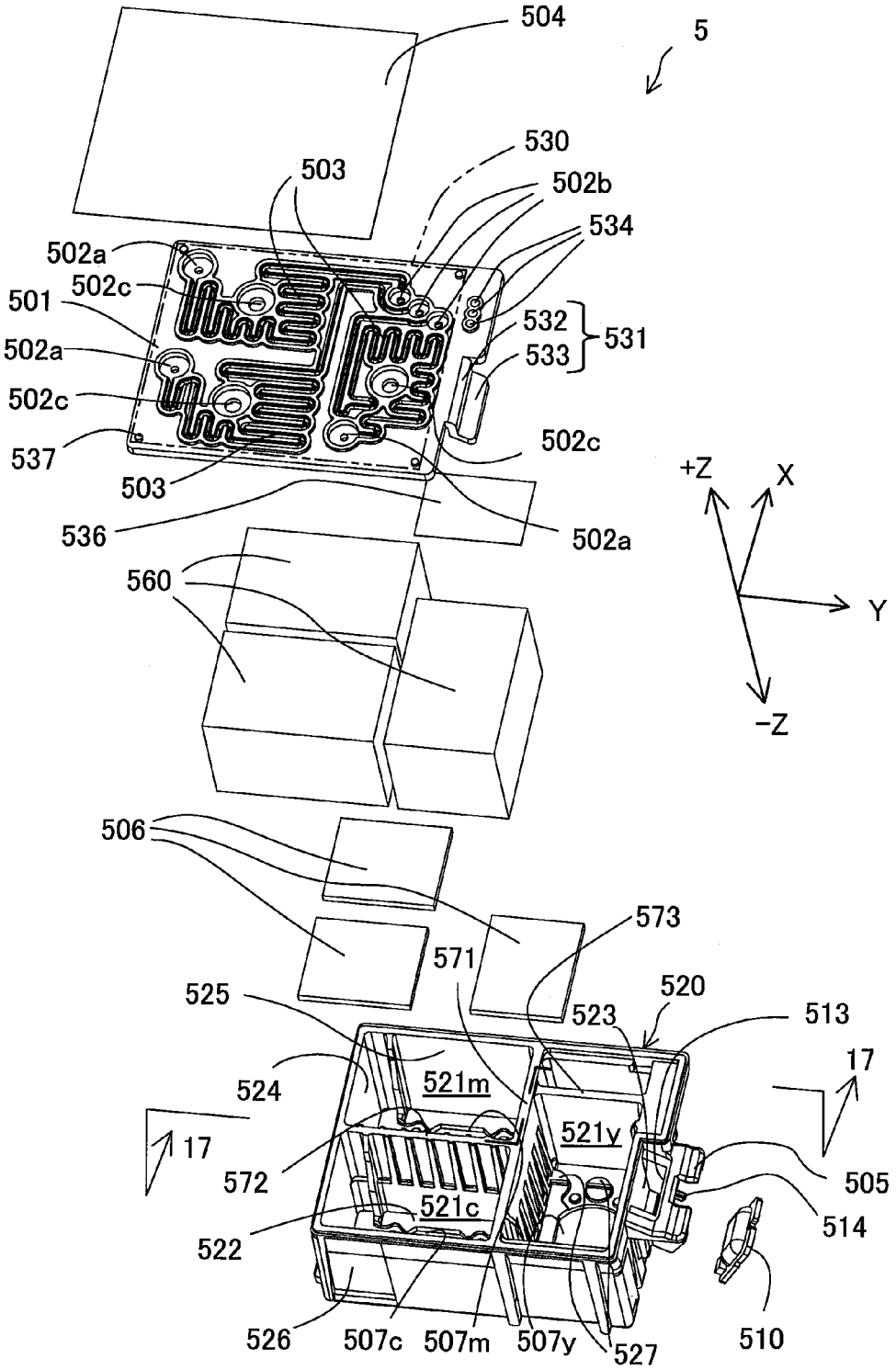
FIG. 13 is an exploded perspective view illustrating the cartridge of FIG. 12.
Figure 14:
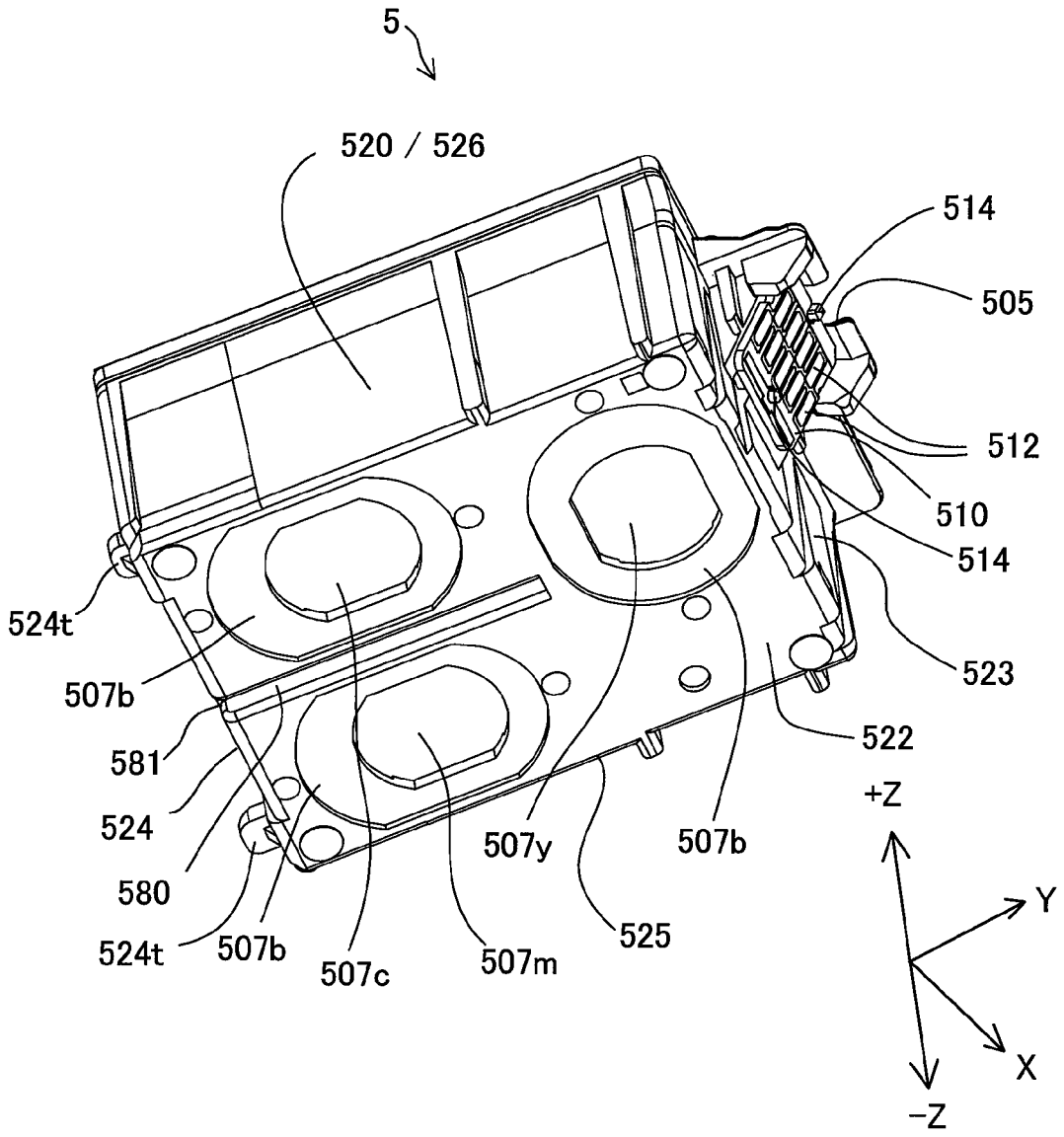
FIG. 14 is an appearance perspective view illustrating the cartridge of FIG. 12 viewed from the bottom side.
Figure 15:
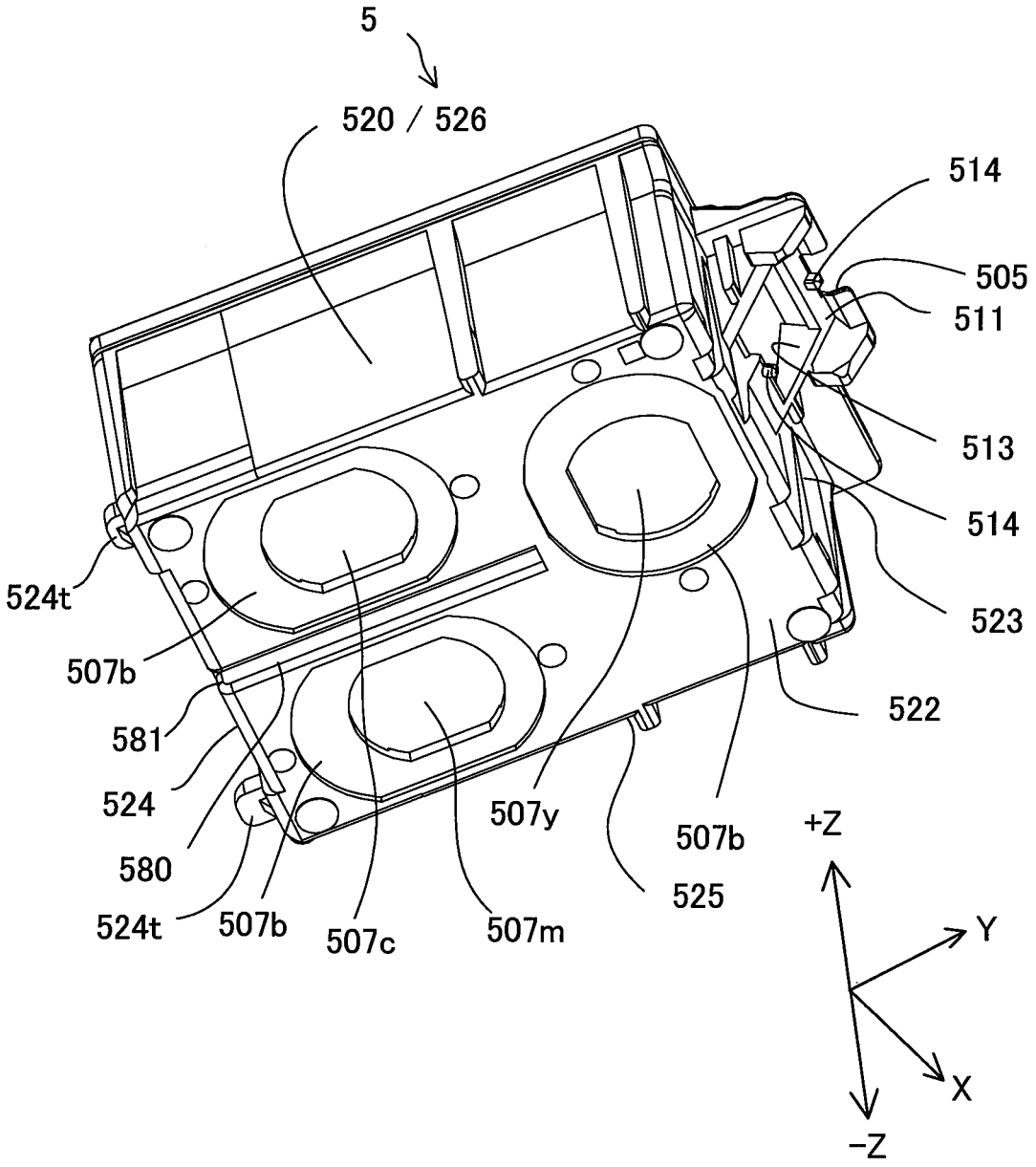
FIG. 15 is an appearance perspective view illustrating the cartridge of FIG. 12 without a circuit substrate viewed from the bottom side.
Figure 16:
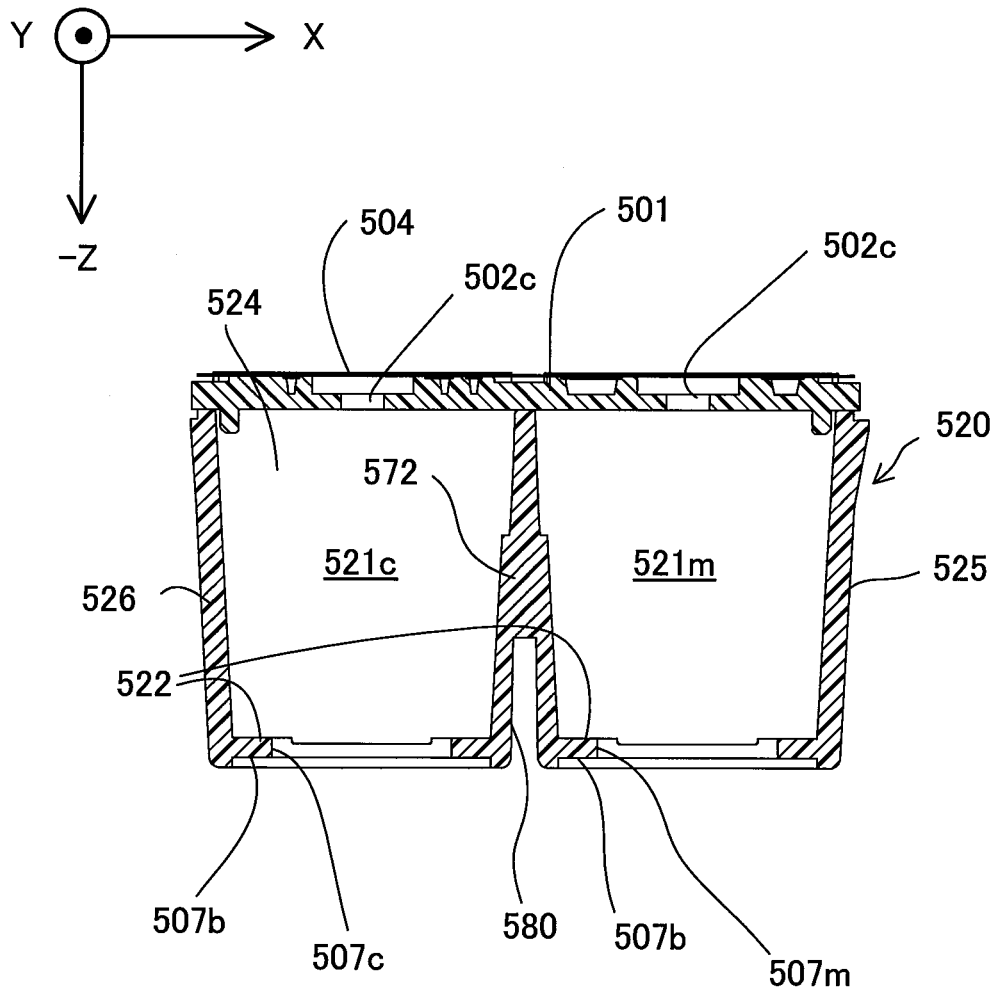
FIG. 16 is a schematic cross sectional end view illustrating a casing, taken on a line 16-16 in FIG. 12.
Figure 17:
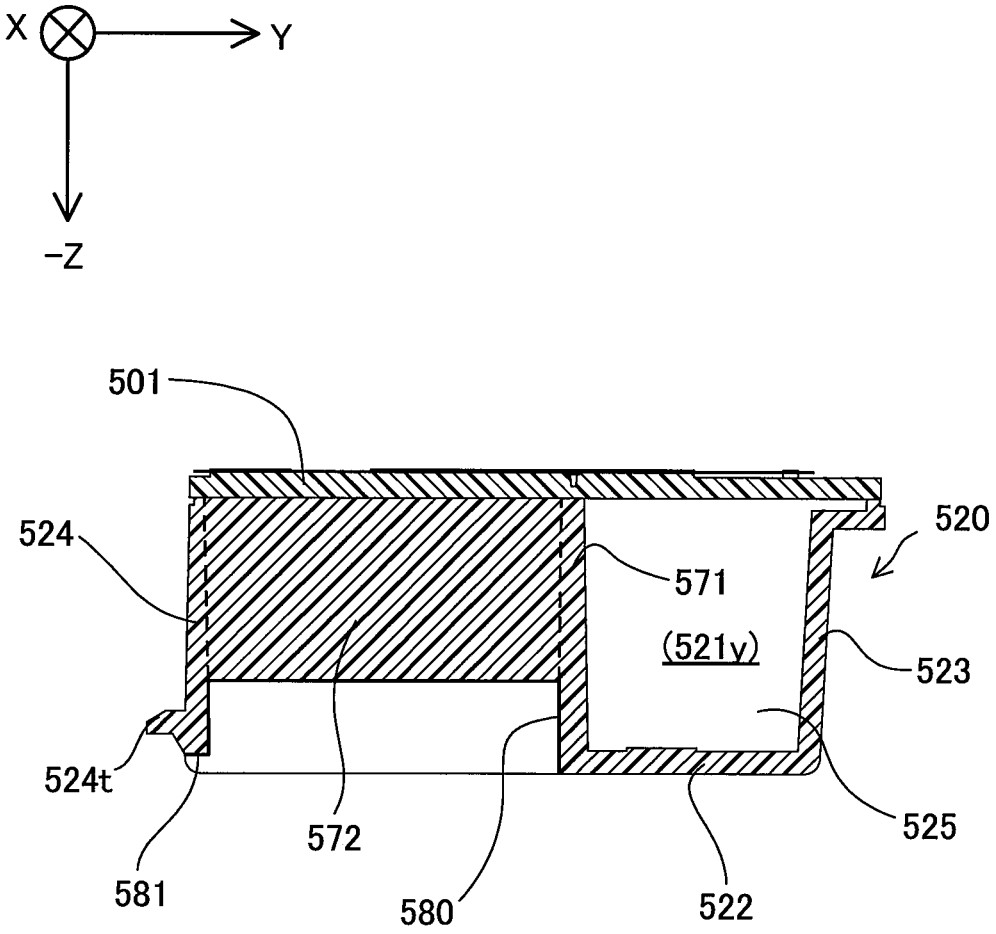
FIG. 17 is a schematic cross sectional end view illustrating the casing, taken on a line 17-17 in FIG. 13.

The cartridge 5 has the different structure from that of the cartridge 4 by containing three different color inks, yellow, magenta and cyan. In the description of the structure of the cartridge 5, the like components to those of the cartridge 4 are expressed by like numerical symbols with the digit at a highest place changed to 5 and are only briefly explained. FIG. 12 is an appearance perspective view illustrating the cartridge 5. FIG. 13 is an exploded perspective view illustrating the cartridge 5. FIG. 14 is an appearance perspective view illustrating the cartridge 5 viewed from the bottom side. FIG. 15 is an appearance perspective view illustrating the cartridge 5 without the circuit substrate 510 viewed from the bottom side. FIG. 16 is a schematic cross sectional end view illustrating a casing 520, taken on a line 16-16 in FIG. 12. FIG. 17 is a schematic cross sectional end view illustrating the casing 520, taken on a line 17-17 in FIG. 13. In the illustration of FIG. 17, a recess 521*y* described later is shown to be located on the front side of the sheet surface in the cross section of the casing 520 taken on the line 17-17 in FIG. 13.

As illustrated in FIG. 13, the cartridge 5 has the casing 520, the cover 501 and the circuit substrate 510. The cover 501 is fixed to the casing 520 to cover three recesses 521*m*, 521*c* and 521*y* of the casing 520 (FIG. 13). The casing 520 has a partition wall 571 located between a first side wall 525 and a second side wall 526, a partition wall 572 located between the partition wall 571 and a second end wall 524 and a partition wall 573 located between the partition wall 571 and a first end wall 523. These partition walls 571, 572 and 573 form the recesses 521*m*, 521*c* and 521*y* corresponding to the respective color inks, magenta, cyan and yellow. The cartridge 5 has supply port-side liquid retaining members 506 placed in respective areas defined by semicircular projections 527 provided on the respective peripheries of ink supply ports 507*m*, 507*y* and 507*c* formed in a bottom wall 522 in the respective recesses 521*m*, 521*c* and 521*y*, and also has liquid retaining members 560 placed on the supply port-side liquid retaining members 506.

The partition walls 571, 572 and 573 and the recesses 521*m* 521*c* and 521*y* have the following positional relationship in the state that the cover 501 is joined with the casing 520. The partition wall 571 is located to intersect with the bottom wall 522, the cover 501, the first side wall 525 and the second side wall 526 and to be opposed to the first end wall 523 and the second end wall 524. The partition wall 572 is located to intersect with the bottom wall 522, the cover 501, the first end wall 524 and the partition wall 571 and to be opposed to the first side wall 525 and the second side wall 526. The recess 521*m* communicating with the ink supply port 507*m* is defined by the bottom wall 522, the cover 501, the second end wall 524, the first side wall 525, the partition wall 571 and the partition wall 572. The recess 521*c* communicating with the ink supply port 507*c* is defined by the bottom wall 522, the cover 501, the second end wall 524, the second side wall 526, the partition wall 571 and the partition wall 572. The recess 521*y* communicating with the ink supply port 507*y* is defined by the bottom wall 522, the cover 501, the first end wall 523, the second side wall 526, the partition wall 571 and the partition wall 573. In one modification, the partition wall 573 may be omitted. In this modified application, the recess 521*y* is defined by the bottom wall 522, the cover 501, the first end wall 523 the first side wall 525, the second side wall 526 and the partition wall 571.

As illustrated in FIGS. 14 and 15, the bottom wall 522, the first end wall 523, the second end wall 524, the first side wall 525 and the second side wall 526 of the casing 520 have the similar structures to those of the corresponding walls of the cartridge 4. The cartridge 5 has the circuit substrate 510 located on the first end wall 523-side of the casing 520. As in the structure of the cartridge 4, the circuit substrate 510 is fixed to a substrate mounting structure 511. The circuit substrate 510 has terminals 512 having substantially the similar structure to that of the cartridge 4. Contacts of the respective terminals 512 are electrically connected with electrodes of the electrode assembly 810 provided on the carriage 8 when the cartridge 5 is attached to the carriage 8 as described above. The substrate mounting structure 511 has the similar structure to that of the cartridge 4. The circuit substrate 510 is fixed to the substrate mounting structure 511 by thermally caulking projections 514 protruded from the substrate mounting structure 511.

As illustrated in FIGS. 12 and 13, the cover 501 has a cover member 530 and an outward extension member 531. The cover member 530 is in a flat plate-like shape and is arranged to cover the recesses 521*m*, 521*c* and 521*y* of the casing 520. The outward extension member 531 is extended outward from the cover member 530 on the first end wall 523-side where the circuit substrate 510 with the terminals 512 is located, and includes a bent extension section 532 and an inclined extension section 533. The structure of these extension sections 532 and 533 is similar to the structure of the cartridge 4. The bent extension section 532 is bent at approximately 90 degrees to the cover member 530 and is extended to be protruded along a first direction from the cover 501 toward the casing 520 (−Z direction in FIG. 13). The inclined extension section 533 continuous with the bent extension section 532 is extended to a location to hang over the terminals 512 of the circuit substrate 510 in the plan view of the cover 501 in the first direction from the cover 501 toward the casing 520 (−Z direction in FIG. 13). In the state that the cover 501 is fixed to the casing 520, the outward extension member 531 is hung over an opening 513 of the substrate mounting structure 511 to close the opening 513 on the upper edge side of the first end wall 523 as shown in FIG. 15. In the state that the cover 501 is fixed to the casing 520, the outward extension member 531 is engaged with an engagement element 505 as shown in FIG. 12. The outward extension member 531 is protruded to the outer side of at least the terminals 512 in the lower line of the circuit substrate 510 in a second direction from the second end wall 524 toward the first end wall 523 (+Y direction in FIGS. 6 and 13). In one modification, the inclined extension section 533 may be extended longer to be protruded to the outer side of all the terminals 512 of the circuit substrate 510.

As illustrated in FIG. 13, the cover 501 has through holes 502*a*, 502*b* and 502*c*, an air groove 503 arranged between the through hole 502*a* and the through hole 502*c* and an air communication hole 534 provided for each of the recesses 521*m* 52*c* and 521*y* corresponding to the respective color inks, magenta, cyan and yellow, and seal member receiving elements 537 formed at respective corners of the cover 501. The seal member receiving elements 537 are protruded from the upper surface of the cover 501 to substantially the same height as the height of the circumferential walls of the through holes 502*a*, 502*b* and 502*c* and the circumferential walls of the air grooves 503 and serve as joint seat elements of the seal member 504.

The three air communication holes 534 are aligned in the X-axis direction in the outer periphery of the cover member 530 and are formed to pass through the cover 501. The through hole 502*b* provided for each of the color inks, yellow, magenta and cyan is formed to pass through the cover 501 and is arranged to be aligned in the Y-axis direction with corresponding one of the air communication holes 534 aligned in the X-axis direction. The air communication hole 534 and the corresponding through hole 502*b* aligned in the Y-axis direction are connected with each other by an air groove (not shown) on the rear surface of the cover 501. This air groove, the cover backside opening of the through hole 502*b* and the cover backside opening of the air communication hole 534 are sealed by a cover backside seal member 536. The recesses 521*m*, 521*c* and 521*y* of the casing 520 closed by the cover 501 are accordingly open to the air through the respective air communication holes 534 via the through holes 502*a*, the air grooves 503 and the through holes 502*b*. The through holes 502*a*, 502*b* and 502*c* and the air grooves 503 are sealed on the upper surface side of the cover 501 by the seal member 504. This arrangement of open to the air described above enables ink contained in the porous liquid retaining member 560 placed in the recess 521*m*, 521*c* or 521*y* for each color ink in the casing 520 closed by the cover 501 to be supplied to the supply port-side liquid retaining member 506 and then to the liquid introducing part 710*m*, the liquid introducing part 710*c* or the liquid introducing part 710*y* (FIG. 4) of the carriage 8 via the corresponding ink supply port 507*m*, 507*c* or 507*y*. In other words, the corresponding color inks are respectively supplied through the ink supply port 507*m* of the recess 521*m* to the liquid introducing part 710*m* of the carriage 8, through the ink supply port 507*c* of the recess 521*c* to the liquid introducing part 710*c* and through the ink supply port 507*y* of the recess 521*y* to the liquid introducing part 710*y*. The respective ink supply ports 507*m*, 507*c* and 507*y* have the following positional relationship.

In the plan view of the casing 520 or the cartridge 5 in a direction from the bottom wall 522 with the ink supply ports 507*m*, 507*c* and 507*y* toward the cover 501 (+Z direction), the ink supply port 507*m* is located between the first side wall 525 and the second side wall 526. The ink supply port 507*c* is located between the ink supply port 507*m* and the second side wall 526.

As shown in FIGS. 14 to 17, the cartridge 5 also has a first groove 580 and a second groove 581 on the bottom surface of the bottom wall 522 (outer wall surface on the −Z direction side) where the ink supply ports 507*m*, 507*c* and 507*y* are formed. The first groove 580 is formed between the ink supply port 507*m* corresponding to the liquid introducing part 710*m* for magenta and the ink supply port 507*c* corresponding to the liquid introducing part 710*c* for cyan (FIG. 4) and is extended from between the ink supply port 507*m* and the ink supply port 507*c* toward the ink supply port 507*y*. The first groove 580 is formed in the partition wall 572 as a concave having such a depth that the guide projection 723 (FIG. 4) of the cartridge attachment structure 7 is inserted in the state of attachment of the cartridge 5 to the cartridge attachment structure 7 (FIGS. 16 and 17) and is extended over the length of the partition wall 572, i.e., between the second end wall 524 and the partition wall 571. The first groove 580 and the ink supply port 507*y* has the following positional relationship described below.

As shown in FIGS. 14, 15 and 17, the first groove 580 is extended from the second end wall 524 toward the first end wall 523. As shown in FIGS. 13 to 15 and 17, the ink supply port 507*y* is located between the first groove 580 and the first end wall 523. There are first to third positional relationships described below in the plan view of the casing 520 or the cartridge 5 in the direction from the bottom wall 522 toward the cover 501 (+Z direction). In the first positional relationship, the ink supply port 507*y* is located between the first groove 580 and the circuit substrate 510 as shown in FIG. 14. In the second positional relationship, the first groove 580 is located between the second end wall 524 and the recess 521*y* as shown in FIG. 17. In the third positional relationship, the first groove 580 is located between the second end wall 524 and a peripheral concaved area 507*b* where the bottom wall 522 comes into contact with the elastic member 705 formed around the liquid introducing part 710*y* (FIG. 4) of the carriage 8. Like the cartridge 4, the width of the first groove 580 in the X-axis direction is set to be narrower than the width of the peripheral concaved area 507*b*. The first groove 580 may be formed to be continuous with the peripheral concaved area 507*b*.

As illustrated in FIG. 17, the second groove 581 is formed in the second end wall 524 as a concave continuous with the first groove 580. The second groove 581 has a shallower depth in a direction from the bottom wall 522 toward the cover 501 than the depth of the first groove 580 in the direction from the bottom wall 522 toward the cover 501.

A-5. Attachment of Cartridges

Figure 18:
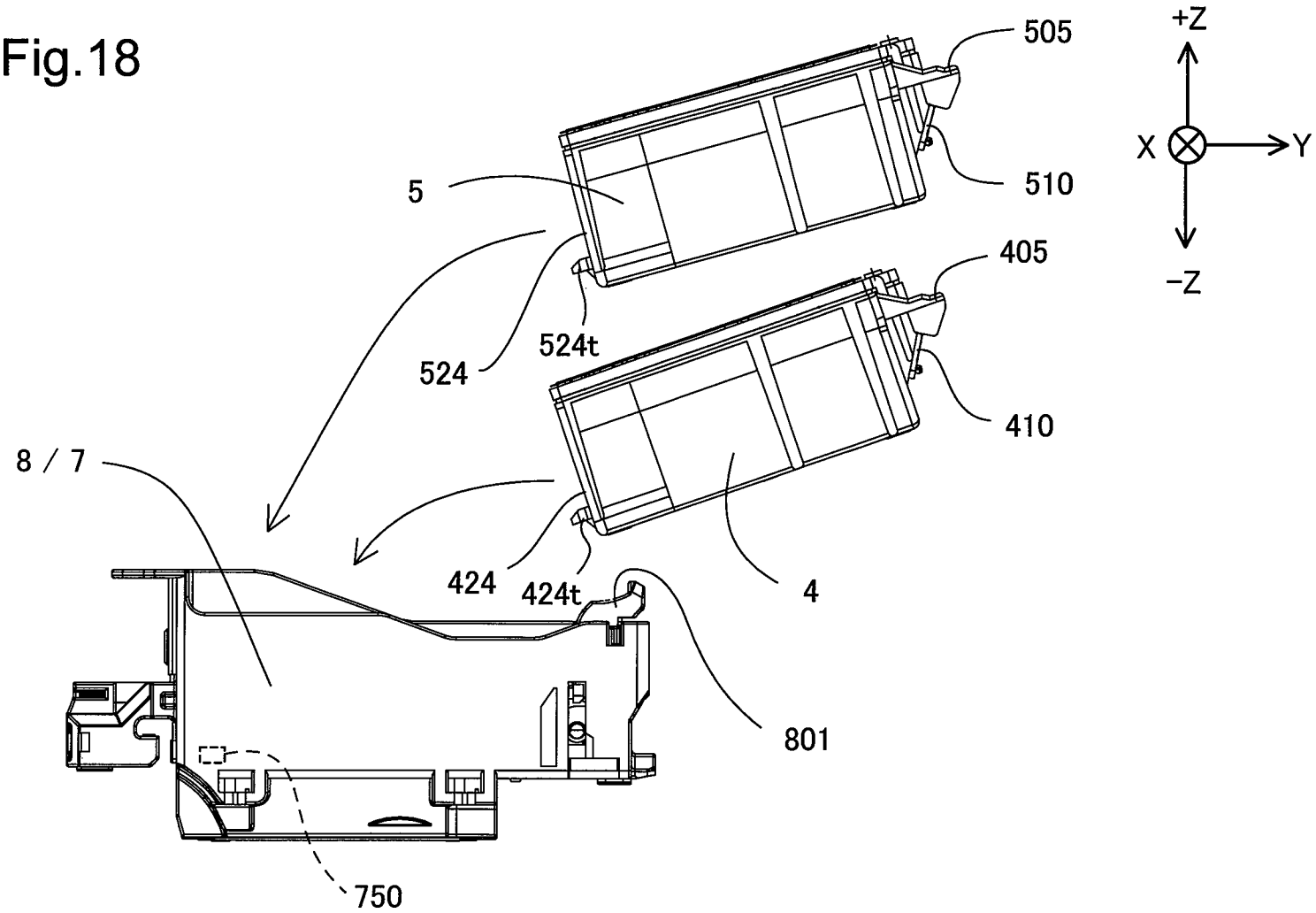
FIG. 18 is a diagram schematically illustrating attachment of the cartridges of FIG. 7 and of FIG. 12 to the carriage.

FIG. 18 is a diagram schematically illustrating attachment of the cartridges 4 and 5 to the carriage 8. As illustrated, in the course of attachment, both the cartridges 4 and 5 are inclined such that the outer wall surfaces of the second end walls 424 and 524 face in the −Z direction when being inserted into the cartridge attachment structure 7 of the carriage 8. The engagement projections 424*t* and 524*t* of the respective cartridges 4 and 5 are subsequently inserted into the engagement holes 750 (FIG. 4) in the cartridge attachment structure 7 of the carriage 8. The respective cartridges 4 and 5 are pressed in the −Z direction against the cartridge attachment structure 7 until the engagement elements 405 and 505 are engaged with the cartridge engagement arms 801 as shown in FIG. 6.

As shown in FIGS. 9 to 11, the cartridge 4 of this embodiment having the configuration described above has the liquid supply port 407 arranged to supply black ink to the carriage 8 of the printer 10 or more specifically to the liquid introducing part 710*b* of the cartridge attachment structure 7 (FIGS. 4 and 6) of the carriage 8, and the circuit substrate 410 electrically connectable with the electrode assembly 810 of the carriage 8 in the printer 10. The liquid supply port 407 is located between the circuit substrate 410 and the groove 450 formed on the bottom surface of the bottom wall 422 to be extended from the second end wall 424. The configuration of the cartridge 4 of this embodiment has the following advantageous effects. The cartridge 4 is inclined in the course of attachment as shown in FIG. 18. The configuration without the groove 450 is likely to make the flow of and diffuse the leaked ink along the bottom surface of the bottom wall 422 in the event of leakage of black ink from the liquid supply port 407. The presence of the groove 450, however, causes the leaked ink to be kept in the groove 450 of the bottom wall 422 (FIG. 11) and thereby suppresses diffusion of the ink leaked from the liquid supply port 407. Additionally, the groove 450 guides the leaked ink in a direction away from the first end wall 423 and accordingly reduces the likelihood that the terminals 412 are exposed to the leaked black ink.

In the plan view of the casing 420 or the cartridge 4 in the direction from the bottom wall 422 toward the cover 401 (+Z direction), the cartridge 4 of the embodiment has the liquid supply port 407 located between the groove 450 and the circuit substrate 410 as shown in FIGS. 9 and 10. This configuration of the cartridge 4 of the embodiment also keeps black ink leaked from the liquid supply port 407 in the groove 450 and suppresses diffusion of the black ink, thus reducing the likelihood that the terminals 412 are exposed to the leaked black ink.

The cartridge 5 of the embodiment is attachable to the carriage 8. The carriage 8 has the liquid introducing parts 710*m*, 710*c* and 710*y* and the guide projection 723 as shown in FIG. 4. The guide projection 723 is formed between the liquid introducing part 710*m* and the liquid introducing part 710*c* and is extended from between the liquid introducing part 710*m* and the liquid introducing part 710*c* toward the liquid introducing part 710*y*. As shown in FIGS. 13 to 15, the cartridge 5 of the embodiment has the ink supply port 507*m* provided to supply magenta ink to the liquid introducing part 710*m*, the ink supply port 507*c* provided to supply cyan ink to the liquid introducing part 710*c* and the ink supply port 507*y* provided to supply yellow ink to the liquid introducing part 710*y*. The first groove 580 is formed between the ink supply port 507*m* and the ink supply port 507*c*. The first groove 580 is extended from between the ink supply port 507*m* and the ink supply port 507*c* toward the ink supply port 507*y* and is formed to allow for insertion of the guide projection 723. The cartridge 5 of the embodiment is inclined as shown in FIG. 18 in the course of attachment. In the event of leakage of yellow ink from the ink supply port 507*y*, the leaked ink is guided to the first groove 580 extended toward the ink supply port 507*y* and is kept in the first groove 580. Accordingly the cartridge 5 of the embodiment suppresses diffusion of ink leaked from the ink supply port 507*y* and prevents contamination by the leaked ink. In the event of leakage of ink from the ink supply port 507*m* or from the ink supply port 507*c*, the leaked ink is also kept in the first groove 580. This accordingly suppresses diffusion of the leaked ink. The cartridge 5 of the embodiment can suppress diffusion of leaked ink by the simple structure of the first groove 580 extended from between the ink supply port 507*m* and the ink supply port 507*c* toward the ink supply port 507*y*.

The cartridge 5 of the embodiment has the bottom wall 522 with the ink supply port 507*m*, the ink supply port 507*c*, the ink supply port 507*y* and the first groove 580 formed therein, the cover 501 opposed to the bottom wall 522, the first end wall 523 arranged to intersect with the bottom wall 522 and the cover 501, the second end wall 524 arranged to intersect with the bottom wall 522 and the cover 501 and opposed to the first end wall 523, the first side wall 525 arranged to intersect with the bottom wall 522 and the cover 501, and the second side wall 526 arranged to intersect with the bottom wall 522 and the cover 501 and opposed to the first side wall 525. As shown in FIGS. 13 to 16, in the plan view of the cartridge 5 in the direction from the bottom wall 522 toward the cover 501, the ink supply port 507*m* is located between the first side wall 525 and the second side wall 526; the ink supply port 507*c* is located between the ink supply port 507*m* and the second side wall 526; the first groove 580 is extended from the second end wall 524 toward the first end wall 523; and the ink supply port 507*y* is located between the first groove 580 and the first end wall 523. The cartridge 5 of this embodiment enables ink leaked from the ink supply port 507*y* to be guided to the first groove 580 extended toward the ink supply port 507*y* on the bottom wall 522 and to be kept in the first groove 580. The cartridge 5 of this embodiment accordingly suppresses the ink leaked from the ink supply port 507*y* from being diffused along the wall surface of the bottom wall 522 and prevents contamination by the leaked ink.

In the cartridge 5 of this embodiment, the first groove 580 is formed between the ink supply port 507*m* which is located between the first side wall 525 and the second side wall 526 and the ink supply port 507*c* which is located between the ink supply port 507*m* and the second side wall 526 and is extended from the second end wall 524 toward the first end wall 523. This configuration also enables ink leaked from the ink supply port 507*m* or ink leaked from the ink supply port 507*c* to be kept in the first groove 580, thus suppressing diffusion of the leaked ink along the wall surface of the bottom wall 522 and preventing contamination by the leaked ink. The cartridge 5 of the embodiment can suppress diffusion of leaked ink by the simple structure of the first groove 580 formed between the ink supply port 507*m* which is located between the first side wall 525 and the second side wall 526 and the ink supply port 507*c* which is located between the ink supply port 507*m* and the second side wall 526 and extended from the second end wall 524 toward the first end wall 523.

As shown in FIG. 14, the contacts of the terminals 512 provided on the circuit substrate 510 located on the outer wall surface of the first end wall 523 in the cartridge 5 of the embodiment are electrically connectable with the electrode assembly 810 of the carriage 8 (FIG. 6). In the plan view of the cartridge 5 in the direction from the bottom wall 522 toward the cover 501, the ink supply port 507*y* is located between the first groove 580 and the circuit substrate 510. The ink leaked from the ink supply port 507*y* is kept in the first groove 580. This configuration suppresses the leaked ink from flowing along the wall surface of the bottom wall 522 and reaching the first end wall 523, thus reducing the likelihood that the terminals 512 are exposed to the leaked ink.

As shown in FIG. 16, the cartridge 5 of the embodiment has the first groove 580 formed as a concave in the partition wall 572 which parts the recess 521*m* and the recess 521*c* from each other. This configuration of the cartridge 5 of the embodiment enables the first groove 580 to be readily formed without reducing the capacities of the recesses 521*m* and 521*c* for containing inks.

In the plane view of the cartridge 5 in the direction from the bottom wall 522 toward the cover 501, the cartridge 5 of the embodiment has the first groove 580 located between the peripheral concaved area 507*b* and the second end wall 524. The cartridge 5 of the embodiment accordingly enhances the effectiveness of keeping ink leaked from the ink supply port 507*y* in the first groove 580 and thereby suppressing diffusion of the leaked ink along the wall surface of the bottom wall 522 described above and the effectiveness of preventing contamination by the leaked ink by the simple structure of the first groove 580 adequately positioned.

As illustrated in FIG. 17, the cartridge 5 of the embodiment has the second groove 581 formed in the second end wall 524 to be continuous with the first groove 580. When the cartridge 5 is inclined to be attached to the carriage 8 as shown in FIG. 18, the second groove 581 approaches the guide projection 723 of the cartridge attachment structure 7 of the carriage 8 earlier than the first groove 580. In the cartridge 5 of the embodiment, the second groove 581 continuous with the first groove 580 first receives the guide projection 723 in the course of attachment of the cartridge 5 to the carriage 8. Insertion of the guide projection 723 into the second groove 581 causes the guide projection 723 to serve as a guide rail in the X-axis direction. This configuration of the cartridge 5 of the embodiment facilitates attachment of the cartridge 5 to the carriage 8 and enhances the fit of the cartridge 5.

In the cartridge 5 of the embodiment, the second groove 581 in the second end wall 524 is formed to have the shallower depth in the direction from the bottom wall 522 toward the cover 501 than the depth of the first groove 580 in the direction from the bottom wall 522 toward the cover 501. As described above, in the course of attachment of the cartridge 5 to the carriage 8, the cartridge 5 is inclined, so that the guide projection 723 of the cartridge attachment structure 7 of the carriage 8 first enters the second groove 581 of the cartridge 5. Setting the depth of the second groove 581 shallower than the depth of the first groove 580 prevents the second end wall 524 from excessively coming close to the liquid introducing part 710*m* or the liquid introducing part 710*c* of the cartridge attachment structure 7. This configuration of the cartridge 5 of the embodiment prevents the second end wall 524 from carelessly coming into contact with the liquid introducing part 710*m* or 710*c* or its periphery of the cartridge attachment structure 7 in the course of attachment of the cartridge 5 to the carriage 8. This is advantageous in terms of avoiding potential damage.

The cartridge 5 of the embodiment has the casing 520 and the circuit substrate 510. The casing 520 has the recesses 521*m*, 521*c* and 521*y* configured to separately contain magenta ink, cyan ink and yellow ink. Additionally, in the cartridge 5 of the embodiment, the casing 520 has the ink supply ports 507*m* 507*c* and 507*y* and the first groove 580, and the circuit substrate 510 is placed on the casing 520. The cartridge 5 of the multi-part structure including the casing 520 and the circuit substrate 510 according to the embodiment enables leaked ink to be kept in the first groove 580 and thereby suppresses diffusions of the leaked ink.

B. Modifications

The invention may be implemented by various other aspects described below.

B-1. Modification of Appearance of Cartridge

Figure 19:
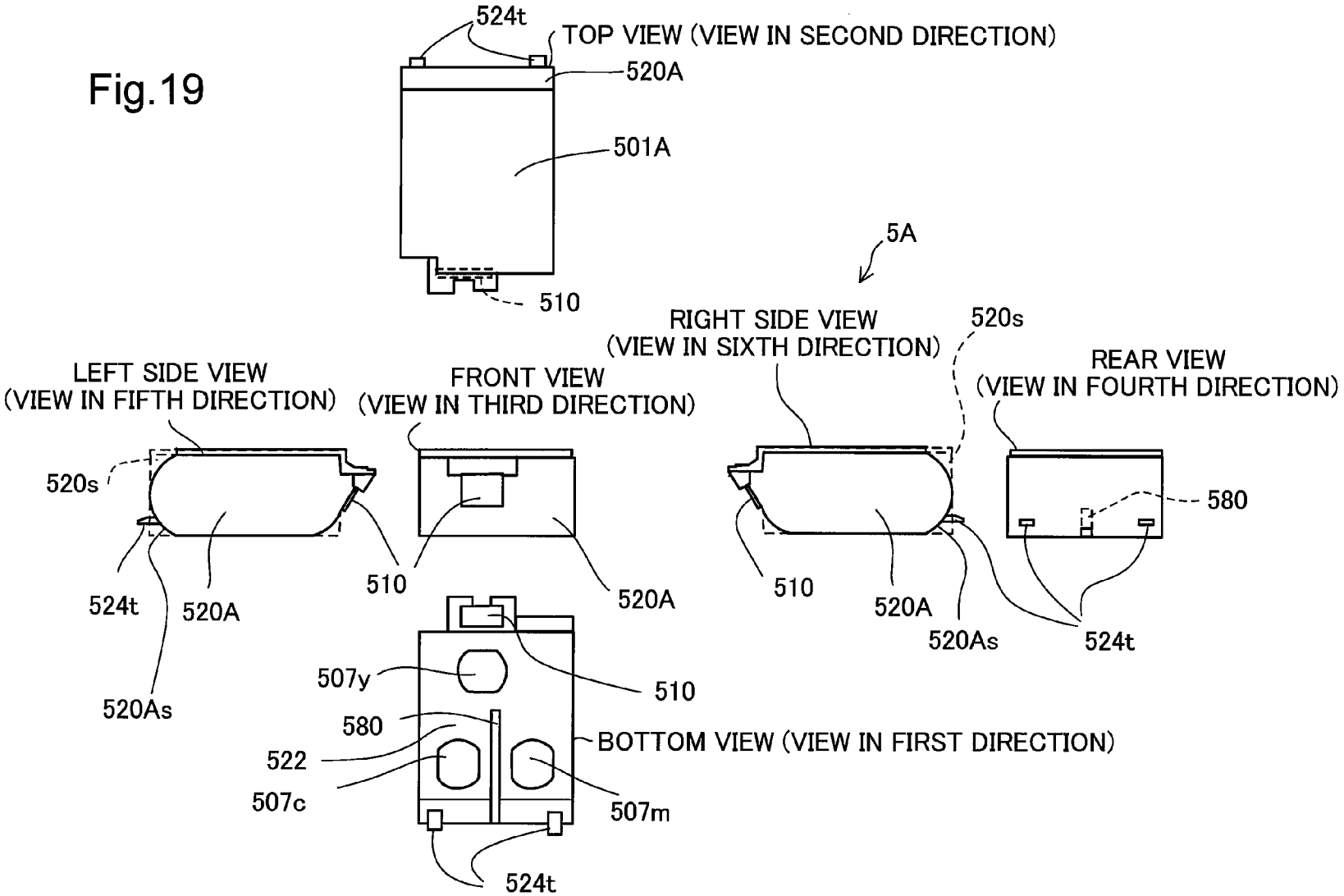
FIG. 19 is diagrams illustrating a modification of the appearance of a cartridge in six different views.

FIG. 19 is diagrams illustrating a modification of the appearance of a cartridge 5A in six different views. In the description below, the like components to those of the cartridge 5 of the above embodiment are expressed by the like numerical symbols and are not specifically described here.

In the plan view of the cartridge 5 of the above embodiment, the direction from the bottom wall 522 toward the cover 501 is set to a first direction. FIG. 19 illustrates a bottom view of the cartridge 5A in this first direction, a top view of the cartridge 5A in a second direction opposite to the first direction, a front view of the cartridge 5A in a third direction orthogonal to the first direction, a rear view of the cartridge 5A in a fourth direction opposite to the third direction, a left side view of the cartridge 5A in a fifth direction orthogonal to the first direction and the third direction and a right side view of the cartridge 5A in a sixth direction opposite to the fifth direction. As illustrated, in the cartridge 5A, appearance 520As of a casing 520A has curved ends in the left and right side views, compared with appearance 520*s* of the casing 520 of the cartridge 5 described above. The degree of curvature may be greater than the degree of curvature illustrated, as long as the area where the first groove 580 and the ink supply ports 507*m* 507*c* and 507*y* are formed remains as flat surface. The cartridge 5A has an ink supply port 507*m*, an ink supply port 507*c*, an ink supply port 507*y*, a first groove 580 and a circuit substrate 510 in a specific part of the casing included in the bottom view, and the ink supply port 507*y* is located between the first groove 580 and the circuit substrate 510.

In the cartridge 5A of the different appearance 520As, the positional relationship between the first groove 580 and the ink supply port 507*y* enables ink leaked from the ink supply port 507*y* to be kept in the first groove 580 and suppresses diffusion of the leaked ink along the wall surface of the bottom wall 522, thus preventing contamination by the leaked ink.

As shown in the bottom plan view of the cartridge 5A in the first direction, this cartridge 5A also has the ink supply port 507*y* located between the first groove 580 and the circuit substrate 510. This configuration enables leaked ink to be kept in the first groove 580 and suppresses diffusion of the leaked ink along the wall surface of the bottom wall 522 toward the circuit substrate 510, thus reducing the likelihood that the circuit substrate 510 is exposed to the leaked ink.

B-2. Cartridge Using Outer Casing

Figure 20:
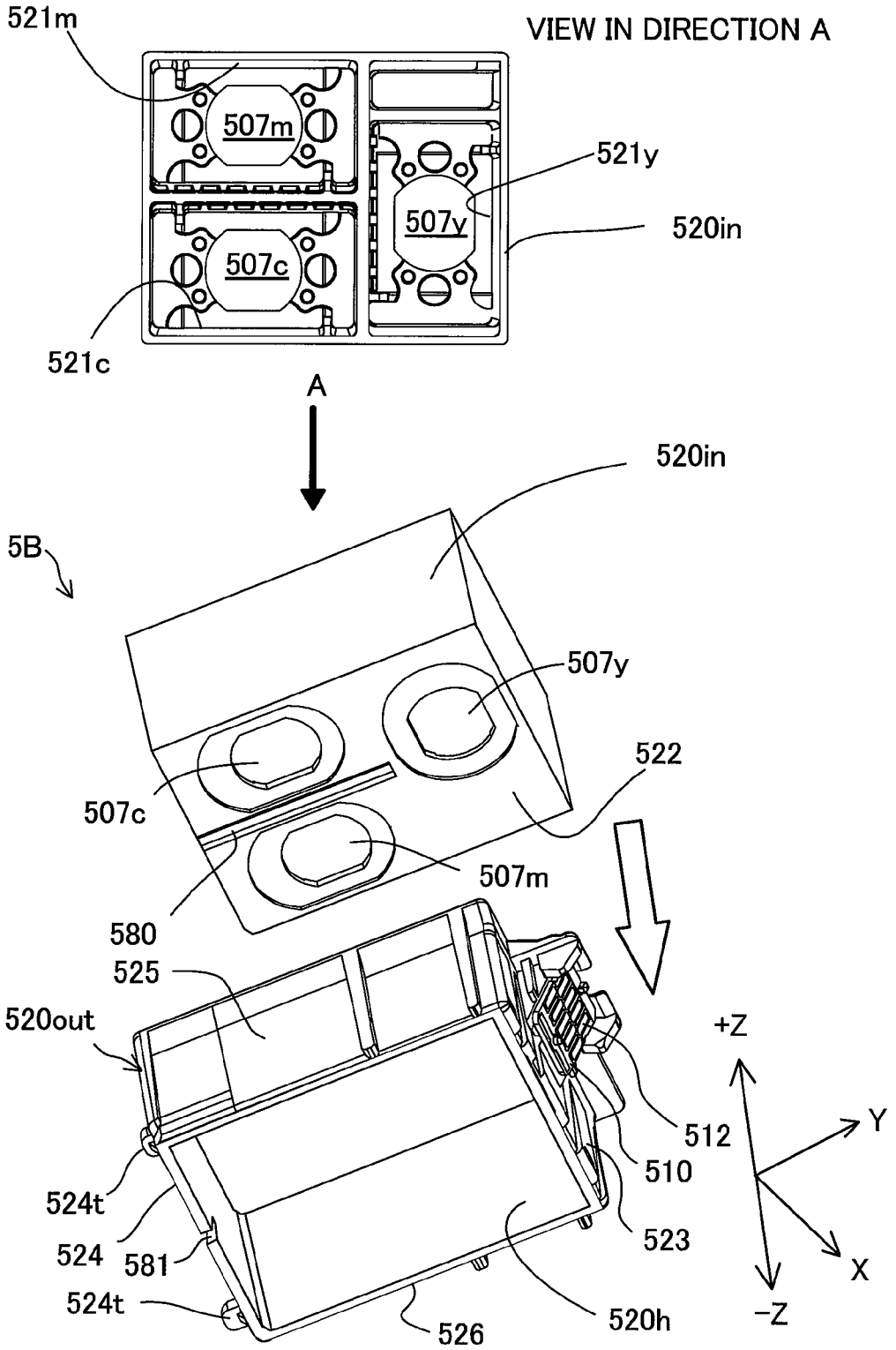
FIG. 20 is diagrams illustrating a schematic exploded view of another cartridge according to a first modification using an outer casing, with a view in a direction A.

FIG. 20 is diagrams illustrating a schematic exploded view of a cartridge 5B according to a first modification using an outer casing, with a view in a direction A. The cartridge 5B has an outer casing 520*out* and an inner casing 520*in*. The outer casing 520*out* has the appearance similar to that of the casing 520 of the above embodiment except the bottom wall 522 and has a casing insertion opening 520*h*. The inner casing 520 in has recesses 521*m* 521*c* and 521*y* configured to separately contain the respective color inks, magenta, cyan and yellow and has ink supply ports 507*m*, 507*c* and 507*y* and a first groove 580 in a bottom wall 522. These recesses an ink supply ports have the similar configurations to those of the casing 520 described above. The outer casing 520*out* also has a circuit substrate 510 electrically connectable with the electrode assembly 810 of the carriage 8. The outer casing 520*out* is attachable to and detachable from the inner casing 520*in* through insertion of the inner casing 520*in* into the casing insertion opening 520*h*. The cartridge 5B in the state that the inner casing 520*in* is inserted in the casing insertion opening 520*h* of the outer casing 520*out* is compatible with the cartridge 5 of the above embodiment. Positioning pins, steps and the like are formed, though not being illustrated, between the outer wall of the inner casing 520*in* and the inner wall of the casing insertion opening 520*h* to position the inner casing 520*in* in the Z-axis direction.

When each color ink is consumed and used up to be replaced, the cartridge 5B of this modification allows for ink refill by simple replacement of the inner casing 520*in*. The cartridge 5B of the multi-part structure including the separable inner casing 520*in* and outer casing 520*out* enables leaked ink to be kept in the first groove 580 and suppresses diffusion of the leaked ink along the wall surface of the bottom wall 522 toward the circuit substrate 510, thus reducing the likelihood that the circuit substrate 510 is exposed to the leaked ink.

Figure 21:
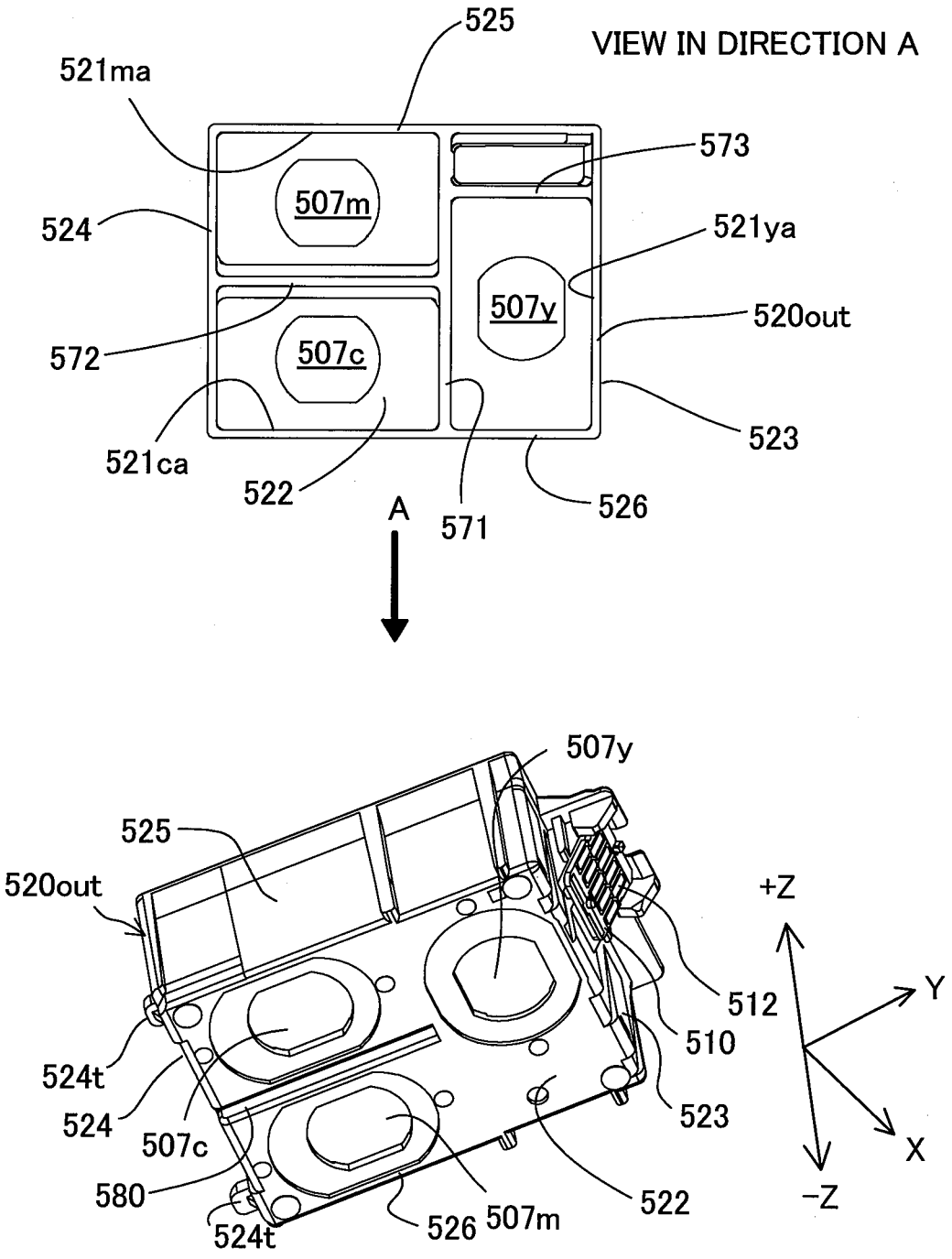
FIG. 21 is diagrams illustrating a perspective bottom view of an outer casing in another cartridge according to a second modification using the outer casing, with a view in a direction A.
Figure 22:
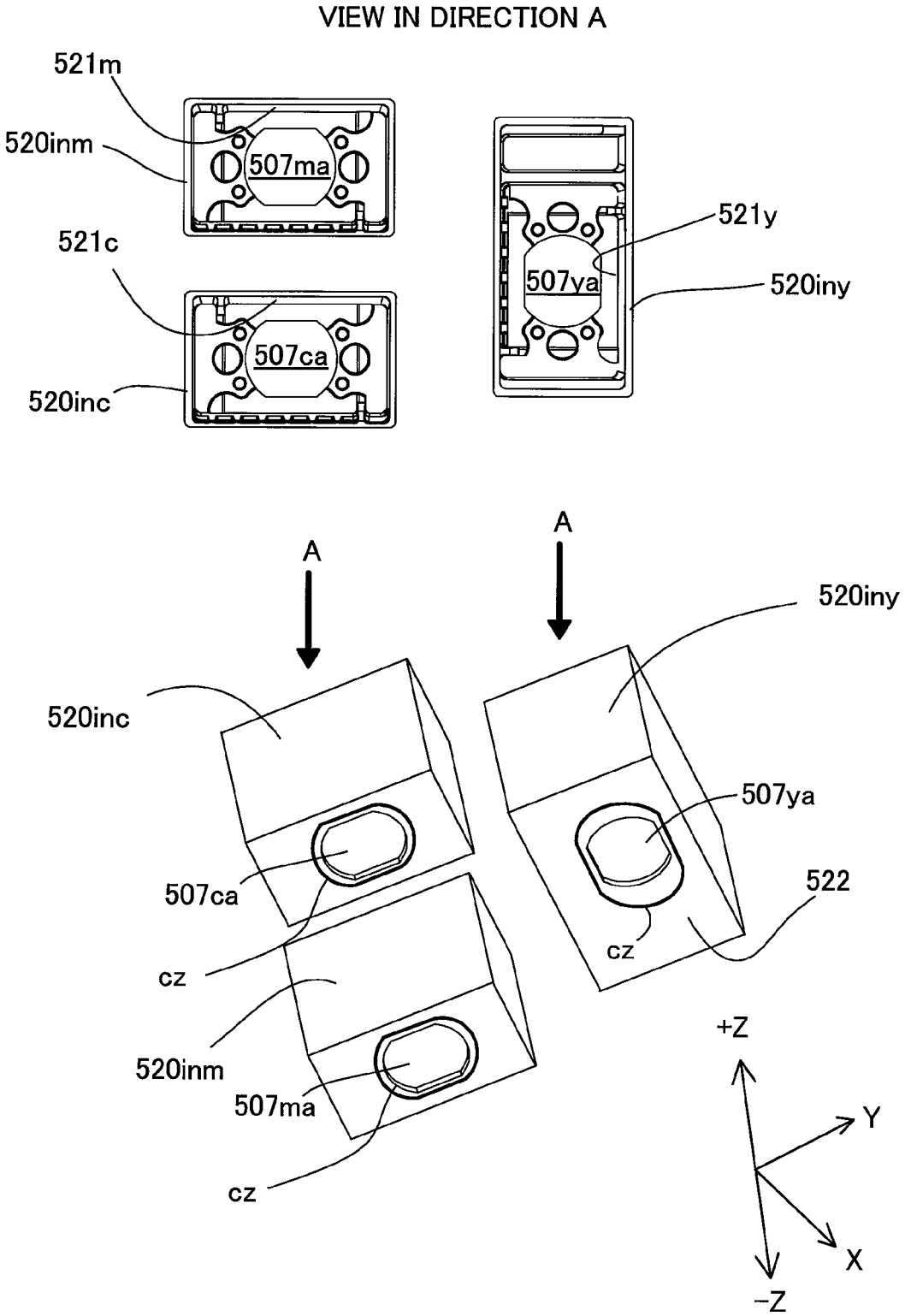
FIG. 22 is diagrams illustrating a perspective bottom view of inner casings for respective color inks in the cartridge of the second modification, with a view in a direction A.
Figure 23:
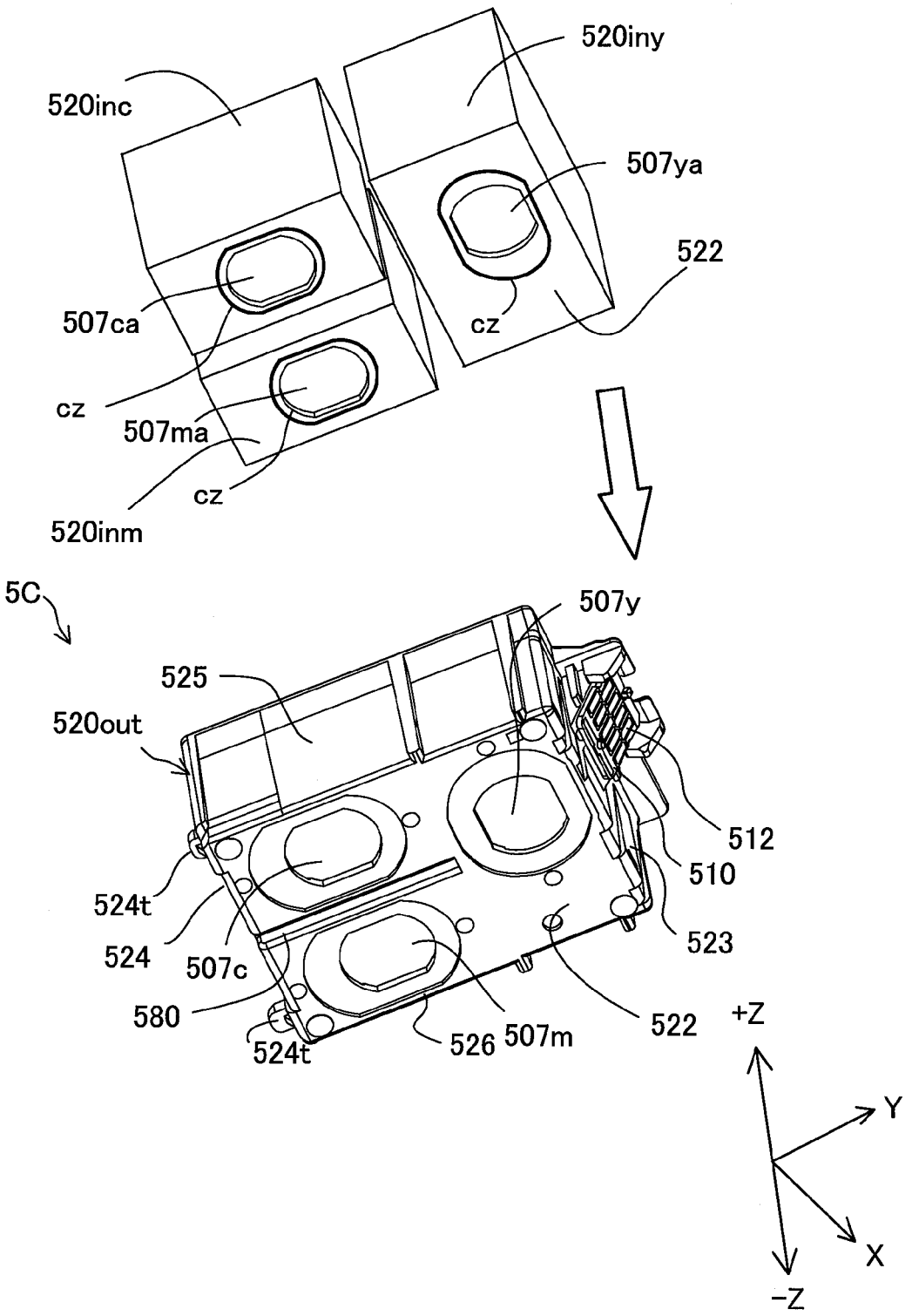
FIG. 23 is a schematic exploded view of the cartridge of the second modification.

FIG. 21 is diagrams illustrating a perspective bottom view of an outer casing 520*out* in a cartridge 5C according to a second modification using the outer casing, with a view in a direction A. FIG. 22 is diagrams illustrating a perspective bottom view of inner casings for respective color inks in the cartridge 5C, with a view in a direction A. FIG. 23 is a schematic exploded view of the cartridge 5C. The cartridge 5C has an outer casing 520*out* and inner casings 520*inm*, 520*inc* and 520*iny*. The outer casing 520*out* has the appearance similar to that of the above casing 520 including the bottom wall 522. As illustrated in FIG. 21, ink supply ports 507*m* 507*c* and 507*y*, and a first groove 580 are formed in a bottom wall 522 of the outer casing 520*out*. The respective ink supply ports and the circuit substrate 510 have similar configurations and are formed at similar positions to those of the casing 520 of the above embodiment. The outer casing 520*out* has the bottom wall 522, a first end wall 523, a second end wall 524, a first side wall 525 and a second side wall 526 surrounding the bottom wall 522, and partition walls 571 to 573 to define casing-receiving recesses 521*ma*, 521*ca* and 521*ya* to individually receive the inner casings 520*inm*, 520*inc* and 520*iny* described below. These casing-receiving recesses 521*ma*, 521*ca* and 521*ya* are supposed to receive the inner casings 520*inm*, 520*inc* and 520*iny* liquid-tightly, so that the bottom wall 522 has the flat inner wall surface.

The inner casing 520*inm* has the external shape to allow for insertion into the casing-receiving recess 521*ma* of the outer casing 520*out* and has a recess 521*m*. The recess 521*m* is formed to have the similar internal shape to that of the recess 521*m* of the casing 520 of the above embodiment and causes the liquid retaining member 560 and the supply port-side liquid retaining member 506 to be placed therein. The inner casing 507*ma* has a through hole 507*ma* which is aligned with the ink supply port 507*m* of the outer casing 520*out* and has a seal member cz arranged to seal the periphery of the through hole 507*ma*. In the state that the inner casing 520*inm* is placed in the casing-receiving recess 521*ma* of the outer casing 520*out*, magenta ink is supplied from the ink supply port 507*m* through the through hole 507*ma* sealed with the seal member cz into the liquid introducing part 710*m* of the carriage 8 (FIG. 4). The inner casing 520*inc* and the inner casing 520*iny* have similar configurations.

The inner casing 520*inm*, the inner casing 520*inc* and the inner casing 520*iny* are respectively connected with the ink supply port 507*m*, the ink supply port 507*c* and the ink supply port 507*y*. This configuration allows magenta ink to be supplied through the ink supply port 507*m* into the liquid introducing part 710*m* of the carriage 8 (FIG. 4), allows cyan ink to be supplied through the ink supply port 507*c* into the liquid introducing part 710*c* and allows yellow ink to be supplied through the ink supply port 507*y* into the liquid introducing part 710*y*. Placing the inner casings 520*inm*, 520*inc* and 520*iny* into the corresponding casing-receiving recesses 521*ma*, 521*ca* and 521*ya* of the outer casing 520*out* completes the cartridge 5C as shown in FIG. 23. The cartridge 5C is compatible with the cartridge 5 of the above embodiment. Positioning pins, steps and the like are formed, though not being illustrated, between the inner walls of the casing-receiving recesses 521*ma*, 521*ca* and 521*ya* of the outer casing 520*out* and the outer walls of the inner casings 520*inm*, 520*inc* and 520*iny* to position the inner casings 520*inm*, 520*inc* and 520*iny* in the Z-axis direction.

When each color ink is consumed and used up to be replaced, the cartridge 5C of this modification allows for ink refill by simple replacement of the inner casing 520*inm*, the inner casing 520*inc* or the inner casing 520*iny*. The cartridge 5C of the multi-part structure including the separable inner casings 520*inm*, 520*inc* and 520*iny* and outer casing 520*out* enables leaked ink to be kept in the first groove 580 and suppresses diffusion of the leaked ink along the wall surface of the bottom wall 522 toward the circuit substrate 510, thus reducing the likelihood that the circuit substrate 510 is exposed to the leaked ink.

Figure 24:
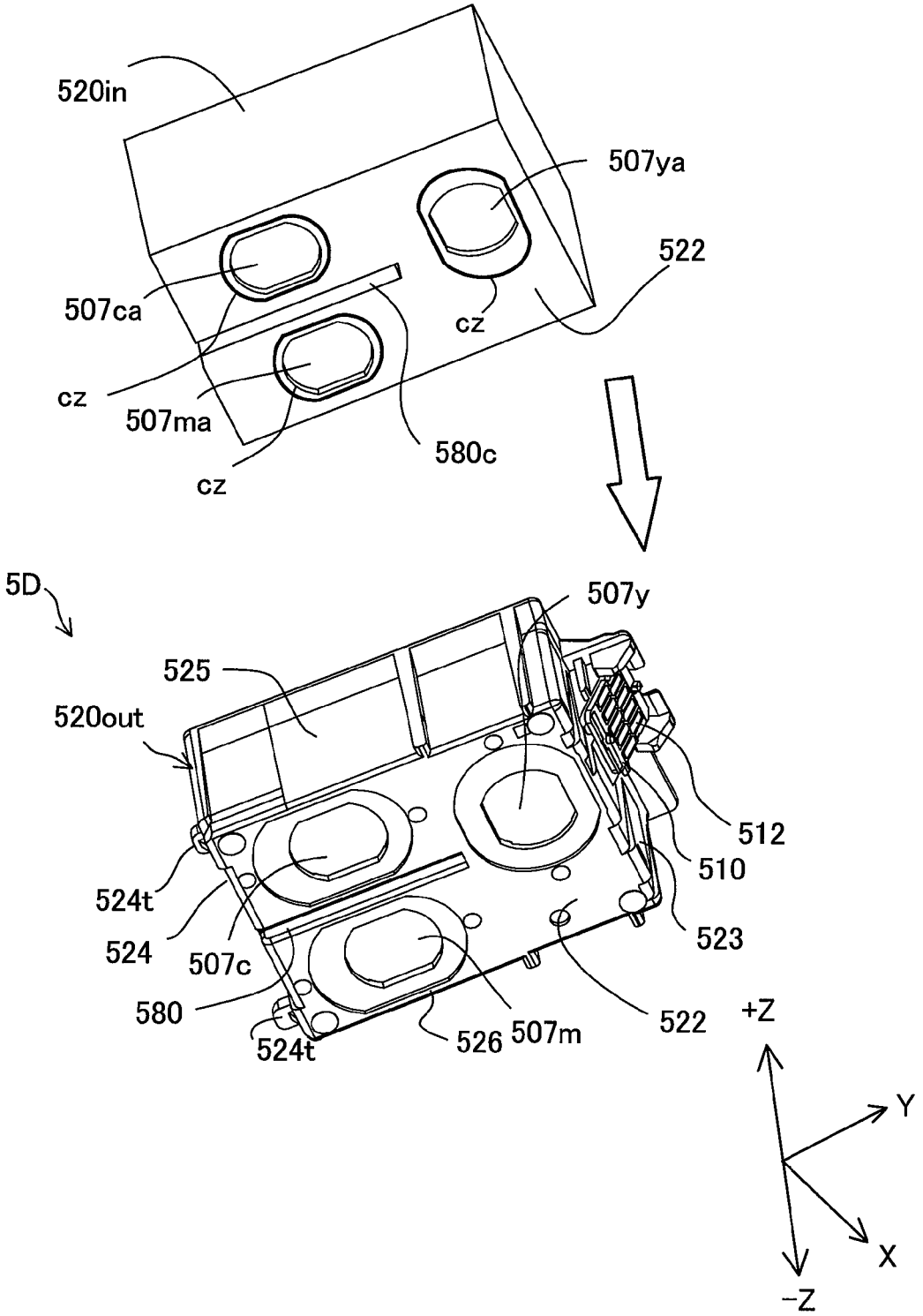
FIG. 24 is a schematic exploded view illustrating another cartridge according to a third modification using the outer casing.

FIG. 24 is a schematic exploded view illustrating a cartridge 5D according to a third modification using the outer casing. The cartridge 5D has an outer casing 520*out* and an inner casing 520*in*. The outer casing 520*out* is substantially similar to that of the second modification described above, while the inner casing 520*in* is equivalent to an integral body of the inner casings 520*inm*, 520*inc* and 520*iny* of the above second modification. In this cartridge 5D, the outer casing 520*out* does not have partition walls 571 and 573 and has a partition wall 572 having such a height as to allow for formation of a first groove 580. For example, the partition wall 572 may be formed to have half the height illustrated in FIG. 17, and the first groove 580 is formed in the partition wall 572. The inner casing 520*in* has a recess 580*c* located between a through hole 507*ma* and a through hole 507*ca* and configured to receive the partition wall 572 with the first groove 580. The cartridge 5D of the multi-part structure also suppresses diffusion of leaked ink and other advantageous effects described above.

Figure 25:
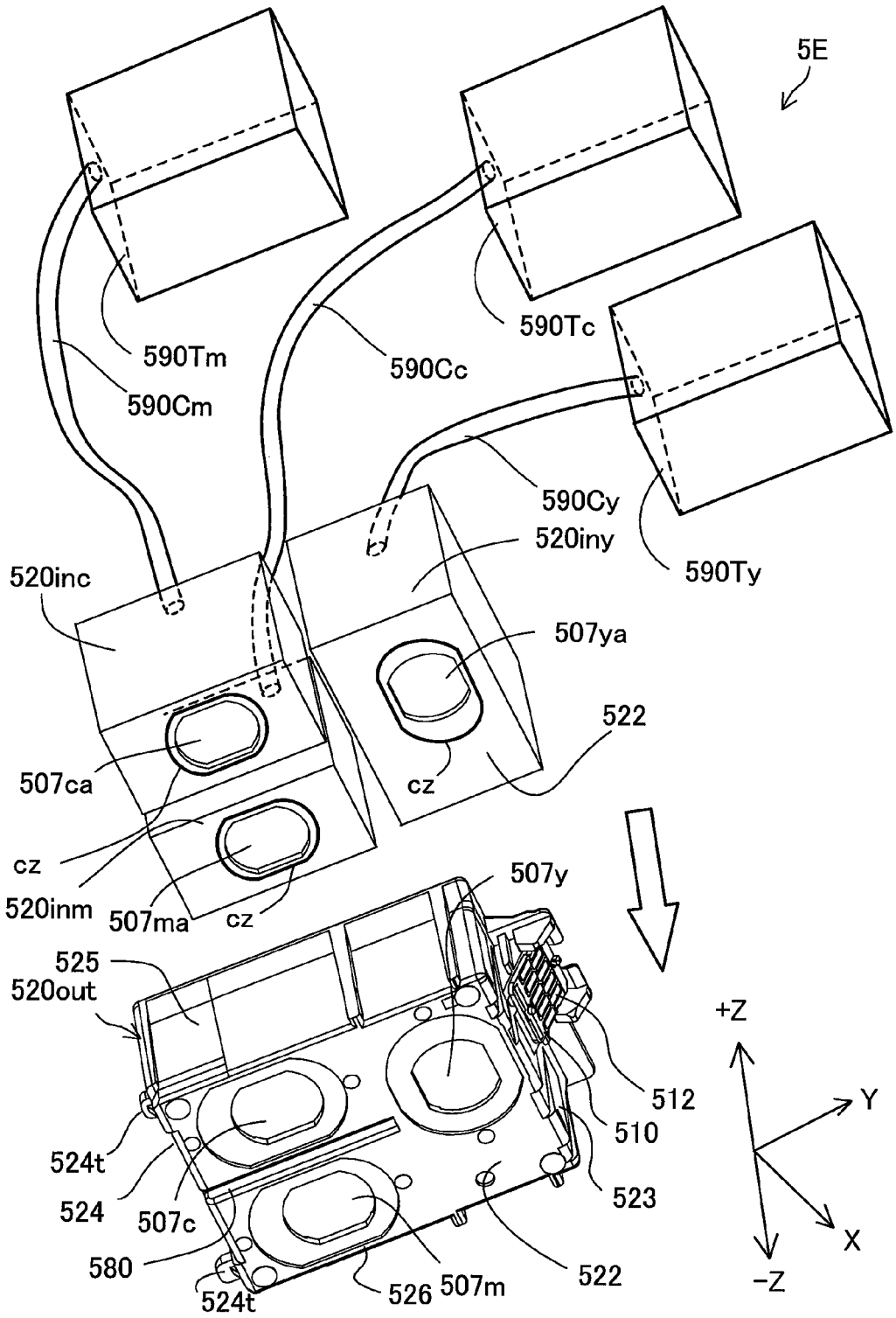
FIG. 25 is a schematic exploded view illustrating another cartridge according to a fourth modification using the outer casing.

FIG. 25 is a schematic exploded view illustrating a cartridge 5E according to a fourth modification using the outer casing. The cartridge 5E has external tanks 590Tm, 590Tc and 590Ty for the respective color inks, magenta, cyan and yellow and tubes 590Cm, 590Cc and 590Cy for the respective color inks, in addition to an outer casing 520*out* and inner casings 520*inm*, 520*inc* and 520*iny*. The outer casing 520*out* is similar to that of the third modification described above, while the inner casings 520*inm*, 520*inc* and 520*iny* are similar to those of the second modification described above. The external tanks 590Tm, 590Tc and 590Ty are configured to contain the respective color inks therein and supply the contained color inks by means of internal pumps (not shown) through the tubes 590Cm, 590Cc and 590Cy to the inner casings 520*inm*, 520*inc* and 520*iny*. The inner casings 520*inm*, 520*inc* and 520*iny* have through holes 507*ma*, 507*ca* and 507*ya* as described above in the second modification. These through holes 507*ma*, 507*ca* and 507*ya* are arranged to respectively communicate with the ink supply ports 507*m*, 507*c* and 507*y* of the outer casing 520*out*. The external tank 590Tm and the tube 590Cm are connectable with the ink supply port 507*m*; the external tank 590Tc and the tube 590Cc are connectable with the ink supply port 507*c*; and the external tank 590Ty and the tube 590Cy are connectable with the ink supply port 507*y*. This configuration allows magenta ink to be supplied through the ink supply port 507*m* into the liquid introducing part 710*m* of the carriage 8 (FIG. 4), allows cyan ink to be supplied through the ink supply port 507*c* into the liquid introducing part 710*c* and allows yellow ink to be supplied through the ink supply port 507*y* into the liquid introducing part 710*y*. The cartridge 5E of the multi-part structure also suppresses diffusion of leaked ink and other advantageous effects described above.

B-3. Other Modifications

The present invention is not limited to the inkjet printer or its ink cartridges but is also applicable to any liquid ejection device configured to eject another liquid but ink and a cartridge (liquid container) configured to contain another liquid. For example, the invention may be applied to any of various liquid ejection devices and their liquid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) liquid ejection device configured to eject a bioorganic material-containing liquid used for manufacturing biochips;

(5) sample ejection device used as a precision pipette;

(6) ejection device of lubricating oil;

(7) ejection device of a resin solution;

(8) liquid ejection device for pinpoint ejection of lubricating oil on precision machines such as watches or cameras;

(9) liquid ejection device configured to eject a transparent resin solution, such as an ultraviolet curable resin solution, onto a substrate in order to manufacture a hemispherical microlens (optical lens) used for, for example, optical communication elements;

(10) liquid ejection device configured to eject an acidic or alkaline etching solution in order to etch a substrate or the like; and

(11) liquid ejection device equipped with a liquid ejection head for ejecting a very small volume of droplets of any other liquid.

The "droplet" herein means the state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, liquid materials in sol-gel process and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

In the embodiment and modifications described above, the guide projection 723 is provided on the cartridge attachment structure 7, while the first groove 580 in which the guide projection 723 is inserted is provided on the cartridge 5. In one modification, the guide projection 723 shown in FIG. 4 may be replaced by a plurality of projections protruded discretely along the length from between the liquid introducing part 710*m* and the liquid introducing part 710*c* adjacent to each other in the X-axis direction to the liquid introducing part 710*y*. The first groove 580 may be formed as a single concave as shown in FIG. 14 or may be formed as a plurality of concaves in which the plurality of projections are individually inserted. The definition of "groove" includes not only a dent portion formed on the cartridge 5 but also a slot completely penetrates through the cartridge 5.

What is claimed is:

1. A liquid supply unit configured to be attachable to and detachable from a liquid ejection device, the liquid supply unit comprising:

a first wall configured to have a first liquid supply port;

a second wall opposed to the first wall;

a third wall arranged to intersect with the first wall and the second wall;

a fourth wall arranged to intersect with the first wall and the second wall, opposed to the third wall;

an inclined surface extending outward and upward from the fourth wall;

a terminal assembly provided on the inclined surface; and a groove provided from the first wall toward the second wall, and extended from the third wall toward the first liquid supply port, wherein in a plan view of the liquid supply unit in a direction from the first wall toward the second wall, the first liquid supply port is located between the groove and the fourth wall.

2. The liquid supply unit according to claim 1, further comprising a second liquid supply port and a third liquid supply port, wherein, in a plan view of the liquid supply unit in a direction from the first wall toward the second wall, the groove is located between the second liquid supply port and the third liquid supply port.

3. The liquid supply unit according to claim 2, further comprising:

a first liquid chamber corresponding to the first liquid supply port;

a second liquid chamber corresponding to the second liquid supply port;

a third liquid chamber corresponding to the third liquid supply port;

a first partition wall provided between the second liquid chamber and the third liquid chamber; and a second partition wall provided between the first liquid chamber and the second and the third liquid chambers, wherein the groove is formed as a concave in the first partition wall.

* * * * *